US006763206B2

(12) United States Patent
Kinouchi et al.

(10) Patent No.: US 6,763,206 B2
(45) Date of Patent: Jul. 13, 2004

(54) IMAGE FORMING APPARATUS WITH AN INDUCTION HEATING FIXING UNIT FOR SHORTENING WARM UP TIME

(75) Inventors: Satoshi Kinouchi, Tokyo (JP); Osamu Takagi, Tokyo (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 79 days.

(21) Appl. No.: 10/143,909

(22) Filed: May 14, 2002

(65) Prior Publication Data

US 2003/0215255 A1 Nov. 20, 2003

(51) Int. Cl.[7] ..... G03G 15/20
(52) U.S. Cl. ..... 399/70; 399/334
(58) Field of Search ..... 399/69, 70, 328, 399/330, 334; 219/601, 643, 644, 660, 661, 663, 667, 216, 388

(56) References Cited

U.S. PATENT DOCUMENTS

| | | | | | |
|---|---|---|---|---|---|
| 4,585,325 | A | * | 4/1986 | Euler | 399/69 |
| 5,666,627 | A | * | 9/1997 | Yamaguchi | 399/330 |
| 5,752,150 | A | * | 5/1998 | Kato et al. | 399/330 |
| 6,026,273 | A | | 2/2000 | Kinouchi et al. | |
| 6,078,781 | A | | 6/2000 | Takagi et al. | |
| 6,087,641 | A | | 7/2000 | Kinouchi et al. | |
| 6,292,647 | B1 | * | 9/2001 | Ishida | 399/330 |
| 6,301,454 | B1 | * | 10/2001 | Nishida et al. | 399/69 |
| 6,320,168 | B1 | * | 11/2001 | Kimata et al. | 219/619 |
| 6,336,027 | B1 | * | 1/2002 | Sakai et al. | 399/328 |
| 6,337,969 | B1 | | 1/2002 | Takagi et al. | |
| 6,438,335 | B1 | | 8/2002 | Kinouchi et al. | |
| 6,463,252 | B2 | * | 10/2002 | Omoto et al. | 399/330 |
| 6,587,654 | B1 | * | 7/2003 | Nishi | 399/67 |
| 2002/0051663 | A1 | | 5/2002 | Kinouchi et al. | |

FOREIGN PATENT DOCUMENTS

| | | | | |
|---|---|---|---|---|
| JP | 2-270293 | | 11/1990 | |
| JP | 8-76620 | | 3/1996 | |
| JP | 9-258586 | | 10/1997 | |
| JP | 2000-206813 | | 7/2000 | |
| JP | 2001-185338 | | 7/2001 | |
| JP | 2002075608 | A * | 3/2002 | H05B/6/04 |

* cited by examiner

*Primary Examiner*—Robert Beatty
(74) *Attorney, Agent, or Firm*—Foley & Lardner LLP

(57) ABSTRACT

A heating apparatus includes first and second coil members, first and second temperature detectors and an output controller. The detectors detect temperature of the coil members. The output controller supplies the first coil member with a first specified output until the first temperature detector detects that the first coil member heats the object. The second coil member is not supplied with a second specified output during this time. When the object reaches a specified temperature, the first specified output stops being supplied to the first coil member and the second specified output is supplied to the second coil member. The temperature of an area heated by the second coil member reaches a specified temperature. A comparison is made between temperatures detected by the first and second temperature detectors. The coil members are alternately supplied with first and second specified outputs to heat the object's area indicating a lower temperature.

22 Claims, 10 Drawing Sheets

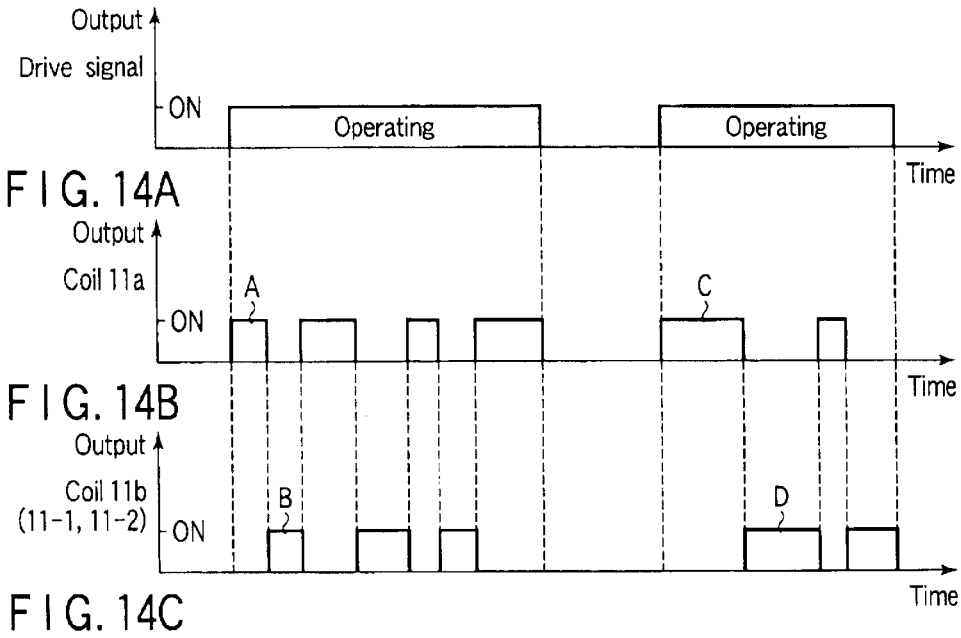
FIG. 14A
FIG. 14B
FIG. 14C
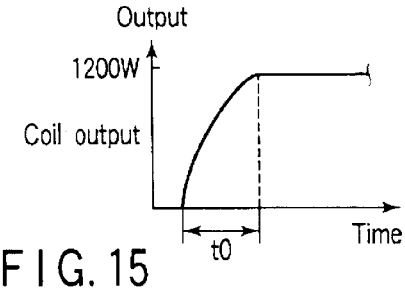
FIG. 15
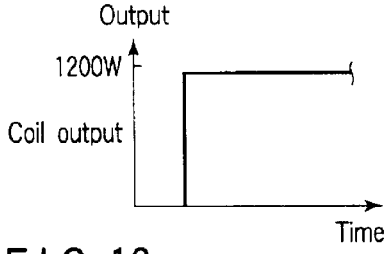
FIG. 16
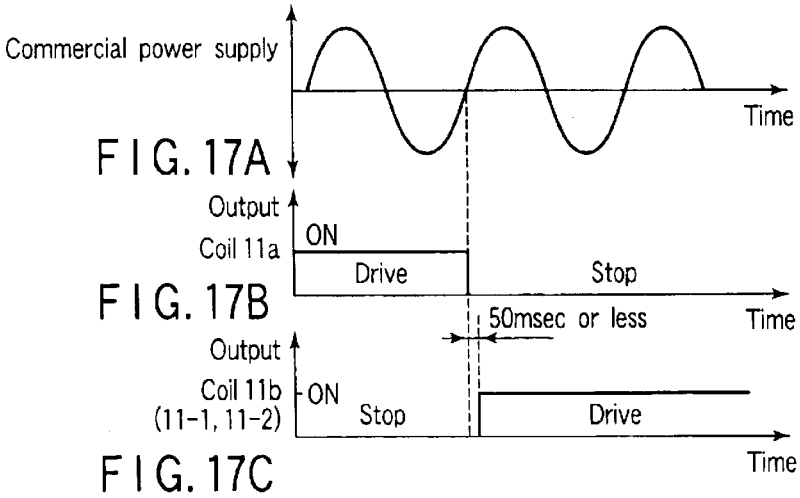
FIG. 17A
FIG. 17B
FIG. 17C

IMAGE FORMING APPARATUS WITH AN INDUCTION HEATING FIXING UNIT FOR SHORTENING WARM UP TIME

BACKGROUND OF THE INVENTION

The present invention relates to a heating apparatus using induction heating. Specifically, the present invention concerns a fixing apparatus which is used for an electrophotographic copying apparatus, printer, etc. using toner as a visualizing material and fixing a toner image.

A fixing apparatus installed in a copying apparatus using electrophotographic processes heats and melts the developer, i.e., toner formed on a fixing member to fix the toner on the fixing member. There are widely known methods of heating toner available for the fixing apparatus such as using radiant heat from a filament lamp, using a flash lamp as a heat source, etc.

The fixing apparatus using a filament lamp uses light and infrared rays from the filament lamp to heat a roller around the lamp by radiation. The thermal conversion efficiency is 60% to 70% in consideration of the loss of heat converted from light, the efficiency of transmitting heat to the roller by heating air in the roller, etc. It is known that a long warm-up time is required.

Jpn. Pat. Appln. KOKAI Publication Nos. 9-258586, 8-76620, and the like propose a fixing apparatus using an induction heating apparatus as the heat source.

Jpn. Pat. Appln. KOKAI Publication No. 9-258586 discloses a fixing apparatus which applies an electric current to an induction coil formed around a core along a rotating shaft of a metal roller and generates an induction current in the roller to generate heat from the roller.

Jpn. Pat. Appln. KOKAI Publication No. 8-76620 discloses the fixing apparatus which comprises an induction film including a magnetic field generation means and a pressure roller adhered to the induction film. This fixing apparatus transports a recording medium between the induction film and the pressure roller and heats the induction film to fix toner on the recording medium.

The fixing apparatus used for copying apparatuses is subject to a specific problem of unevenly generating temperature on the metal roller or the film due to an ununiformed size of paper to be fixed (paper passage width). It is requested to shorten the time to warm up the fixing apparatus.

In order to prevent uneven temperature for the paper passage width, there are provided a plurality of induction coils in accordance with the paper passage width along an axial direction of a fixing roller to control electric power supplied to each coil. This example is disclosed in Jpn. Pat. Appln. KOKAI Publication No. 2000-206813. The fixing apparatus disclosed in this publication uses a plurality of detection points to detect heating of the fixing roller and controls the electric power supplied to the respective coils based on the temperature detected at each detection point.

Jpn. Pat. Appln. KOKAI Publication No. 2001-185338 discloses an example of providing a plurality of induction coils for an image forming apparatus using an induction heating apparatus in order to eliminate uneven heating. When a plurality of coils is powered, the example changes the high-frequency power supplied to any coil to the parallel connection. When a plurality of coils is powered simultaneously according to the example in this publication, each coil is connected to a common (same) high-frequency power supply, providing the same phase to electric current supplied to respective coils. It is possible to independently set the power supplied to each coil.

Jpn. Pat. Appln. KOKAI Publication No. 2-270293 discloses an induction heating apparatus having two induction coils. There is provided a zero-voltage detection circuit to detect a zero point of the alternating-current (input) power supply. The publication discloses changeover of electric current supplied to a targeted coil by passing the zero point (0 volt) of the alternating-current (input) power supply. During the changeover of electric current supplied to a targeted coil, an impulse sound (interference sound) occurs between the coil and the roller. To prevent this sound, there is disclosed provision of a specified time interval at the changeover time.

According to the method of driving coils disclosed in the above-mentioned Jpn. Pat. Appln. KOKAI Publication No. 2000-206813, the power supplied to a plurality of coils changes simultaneously. Because of this, a frequency difference occurs between high-frequency currents supplied to respective coils, causing an interference sound (buzzing). Further, there must be independently provided an apparatus to detect the magnitude of power supplied to each coil. In addition, the warm-up time is prolonged when every possible effort is made to uniform the axial temperature of the metal roller.

Jpn. Pat. Appln. KOKAI Publication No. 2001-185338 discloses the common high-frequency power supply apparatus to which respective coils are connected in order to prevent an inverter's interference. However, there are not disclosed actual control timings, control methods, etc. in detail. Nothing is disclosed about a method of shortening the warm-up time.

The method of driving coils disclosed in Jpn. Pat. Appln. KOKAI Publication No. 2-270293 uses the soft start feature to prevent occurrence of an excess rush current or to prevent application of a power larger than the controlled one. Soft start is a method of driving coils for preventing an excess rush current from occurring. When a coil is powered, the method feeds back the power by gradually applying an output smaller than the specified output value until this specified value is reached.

When the soft start is performed each time each coil is powered, the heating efficiency degrades and the warm-up time increases. There also arises a problem of increasing the amount of the varying power supplied to each coil. The power supplied to each coil is switched by passing the zero point of the alternating-current power (input) voltage and providing a specified time interval. This causes a flicker etc. caused by the power fluctuation when the coils are changed.

BRIEF SUMMARY OF THE INVENTION

It is an object of the present invention to provide an image forming apparatus using an induction heating fixing apparatus capable of shortening the warm-up time.

The present invention provides a heating apparatus comprising:

- a first coil member and a second coil member, wherein each coil member heats an object;
- a first temperature detection mechanism and a second temperature detection mechanism, wherein the first temperature detection mechanism detects a temperature as a result of heating the object by supplying the first coil member with a first specified output and the second temperature detection mechanism detects a temperature as a result of heating the object by supplying the second coil member with a second specified output; and an output control mechanism which can respectively supply the first and second coil members with the first and second specified outputs, wherein the output control mechanism continuously supplies the first coil member with the first specified output until the first temperature detection mechanism detects that the first coil member heats the object and consequently the temperature of an area heated by the first coil member reaches a specified temperature, and the second coil member is not supplied with the second specified output while the first coil member is supplied with the first specified output.

Further, the present invention provides a heating apparatus comprising:

a first coil member and a second coil member, wherein each coil member heats an object;

a first temperature detection mechanism and a second temperature detection mechanism, wherein the first temperature detection mechanism detects a temperature as a result of heating the object by supplying the first coil member with a first specified output and the second temperature detection mechanism detects a temperature as a result of heating the object by supplying the second coil member with a second specified output; and an output control mechanism which can respectively supply the first and second coil members with the first and second specified outputs, wherein the output control mechanism can select either a first control method of simultaneously driving the first and second coil members or a second control method of not driving the other coil member when the first coil member or the second coil member is driven.

Moreover, the present invention provides a heating apparatus comprising:

a first coil member and a second coil member, wherein each coil member heats an object;

a first temperature detection mechanism configured to detect a temperature as a result of heating the object by supplying the first coil member with a first specified output and a second temperature detection mechanism configured to detect a temperature as a result of heating the object by supplying the second coil member with a second specified output; and an output control mechanism which can respectively supply the first and second coil members with the first and second specified outputs, wherein when the first and second coil members are supplied with the first and second specified outputs, from a state of all coil members turned off, at least either coil member is supplied with either of the first and second specified outputs and wherein, until the heating intensity generated from the coil member supplied with the output reaches a specified magnitude, the output control mechanism gradually increases the first and second specified outputs at a given interval.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

FIGS. 14A, 14B, and 14C are timing charts for chronologically showing specified outputs according to another example of drive control applicable to the heating apparatus using a coil as a heat-up mechanism;

FIG. 15 is a graph showing an output change of the coil with the use of a soft start in FIG. 14B;

FIG. 16 is a graph showing an output change of the coil in FIG. 14C by directly supplying a specified output to the coil without the use of a soft start in FIG. 14C; and FIGS. 17A, 17B, and 17C are timing charts for explaining an example of timing for changing coils to be driven in the heating apparatus containing a plurality of coils.

DETAILED DESCRIPTION OF THE INVENTION

Referring now to the accompanying drawings, the following describes a digital copying apparatus as an example of the image forming apparatus to which embodiments of the present invention are applied.

Figure 1:
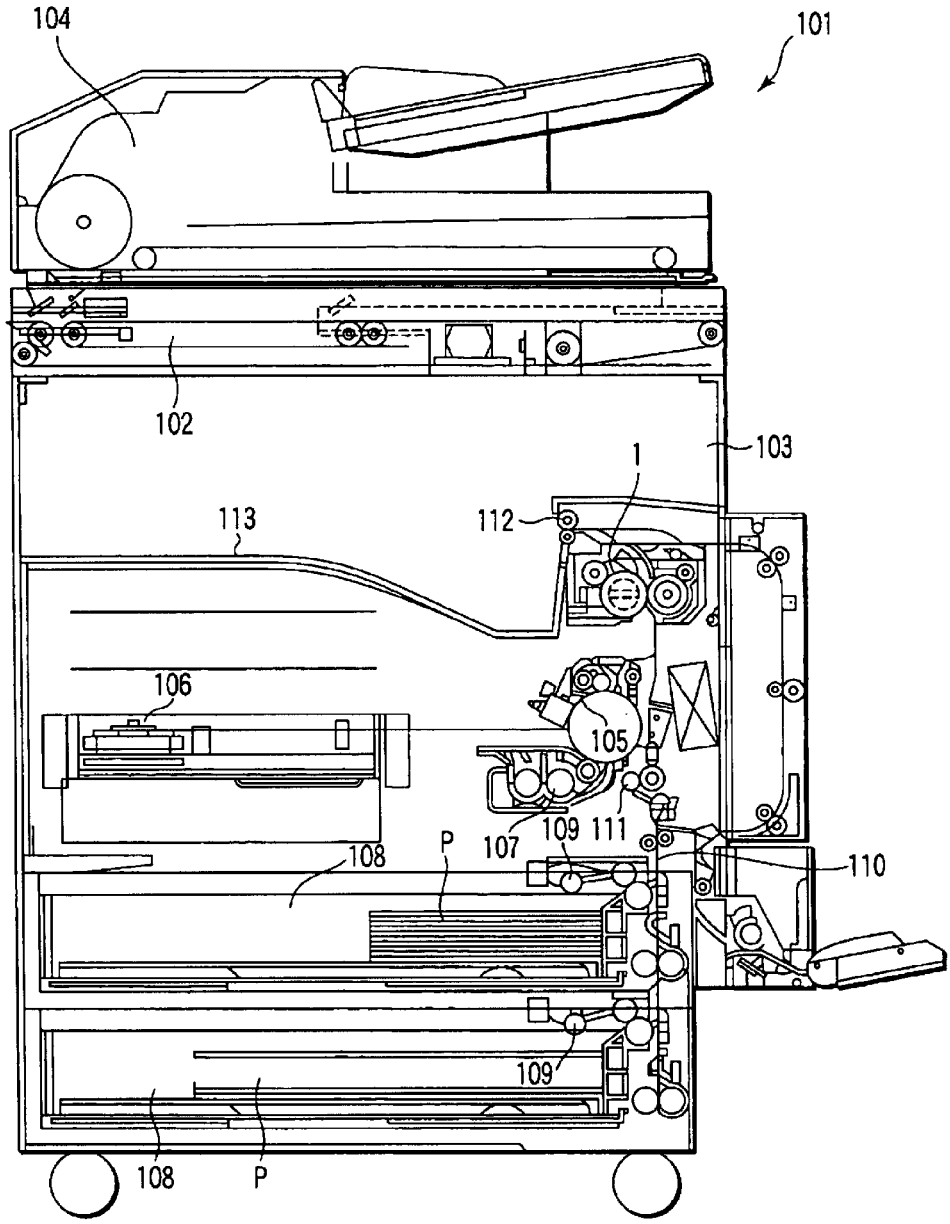
FIG. 1 schematically shows an example of an image forming apparatus which installs an induction heating fixing apparatus according to the present invention.

As shown in FIG. 1, a digital copying apparatus (image forming apparatus) 101 includes an image reading apparatus (scanner) 102 and an image forming section 103. The scanner 102 photoelectrically converts an object image as brightness and darkness of the light to generate an image signal. The image forming section 103 forms an image corresponding to the image signal supplied from the scanner 102 or from the outside and fixes the formed image on paper P as a fixing member (copy material).

The image forming section 103 contains a cylindrical photosensitive drum 105. A photo conductor is formed on the drum's external surface. When the light is irradiated with a specified electric potential supplied, the electric potential changes at the area where the light is irradiated. The photo conductor can maintain the electric potential change as an electrostatic image for a specified time period.

An exposing apparatus 106 exposes image information onto the photosensitive drum 105. The exposing apparatus 106 can generate a laser beam with variable light intensity in accordance with the image information supplied from the scanner 102 or an external apparatus. In this manner, an electrostatic image is formed on the photosensitive drum 105. A developing apparatus 107 selectively supplies toner (developer) to visualize the image formed on the photosensitive drum 105.

Supplying toner from the developing apparatus 107 develops a toner image, i.e., an aggregate of toner, on the photosensitive drum 105. When a transfer apparatus (not detailed) supplies a voltage for transfer, the toner image is transferred to a transfer material P supplied from a paper feed section to be described.

The fixing apparatus 1 applies heat and pressure to melt the toner image transferred to the transfer material P. The image is fixed to the transfer material P due to the pressure from the fixing apparatus.

The image forming apparatus is supplied with an image signal from the scanner 102 or an external apparatus. The exposing apparatus 106 irradiates a laser beam (not detailed) to a specified position of the photosensitive drum 105 which is already charged to a specified electric potential. Thus, the photosensitive drum 105 forms an electrostatic latent image corresponding to the image to be copied (output).

When the developing apparatus 107 selectively supplies toner, the electrostatic latent image formed on the photosensitive drum 105 is developed and is converted to a toner image (not shown).

The toner image on the photosensitive drum 105 is transferred to a transfer material, i.e., paper P at a transfer position opposite the transfer apparatus assigned with no reference numeral. The paper P is transferred to the transfer position. Though not detailed, a pickup roller 109 takes out the paper P sheet by sheet from a paper cassette 108. The paper P is then transported to an aligning roller 111. The paper P is fed to the transfer position with the adjusted paper feed timing.

When the transfer apparatus transfers the toner onto the paper P, it is transported to the fixing apparatus 1. The fixing apparatus 1 melts the toner on the paper P and applies pressure to fix the toner on the paper P.

Figure 2:
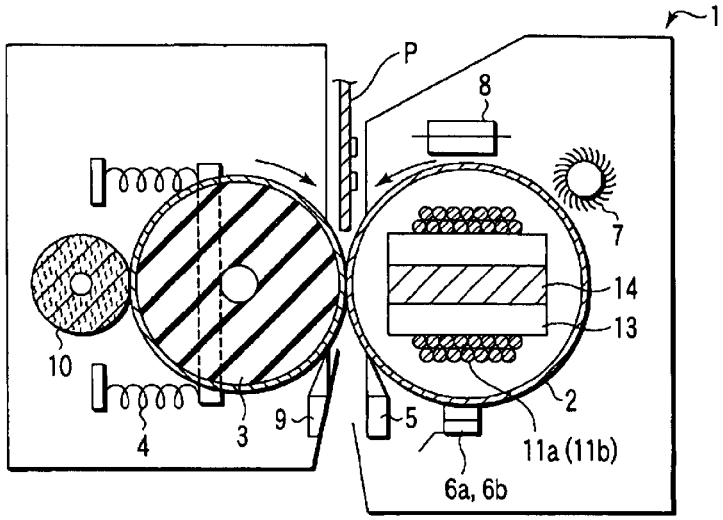
FIG. 2 is a sectional view schematically showing an example of an induction heating fixing apparatus usable for the image forming apparatus as shown in FIG. 1.
Figure 3:
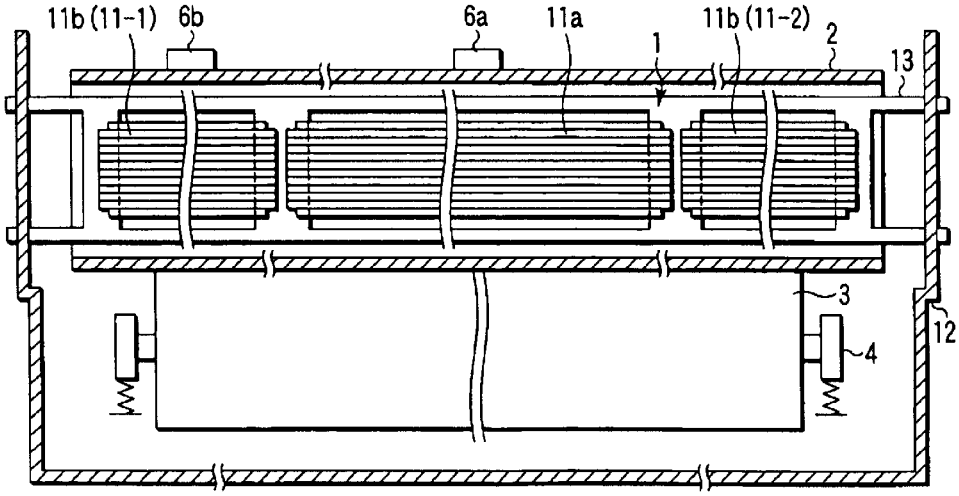
FIG. 3 is a plan view schematically showing the fixing apparatus in FIG. 2 with a cover etc. removed.

FIGS. 2 and 3 schematically show an example of the fixing apparatus used for the image forming apparatus as shown in FIG. 1. FIG. 2 is a cross sectional view taken along a longer direction of the fixing apparatus 1 at the approximate center. FIG. 3 is a plan view schematically showing the fixing apparatus 1 with a cover etc. (not detailed) removed.

The fixing apparatus 1 comprises a heating (fixing) roller 2 approximately 50 mm in diameter and a pressure roller 3 approximately 50 mm in diameter.

The fixing roller 2 is made of metal approximately 1.5 mm thick. In this example, the fixing roller 2 is made of iron and is cylindrical. On the surface of the fixing roller 2, there is formed a release layer (not shown) by depositing fluorocarbon resin such as polytetrafluoroethylene (Teflon as a brand name) for a specified thickness.

Available materials for the fixing roller 2 include stainless steel, aluminum, alloys of stainless steel and aluminum, etc. In this example, the fixing roller 2 is approximately 340 mm long.

Instead of the fixing roller 2, it is possible to use a metallic film formed in an endless belt by depositing metal for a specified thickness on the surface of a highly heat-resistant resin film.

The pressure roller 3 is an elastic roller coated with silicon rubber, fluoro rubber, etc. having a specified thickness around a shaft having a specified diameter. The pressure roller 3 is approximately 320 mm long.

The pressure roller 3 is placed approximately parallel to an axis line of the fixing roller 2. A pressurization mechanism 4 presses the pressure roller 3 with a specified pressure against the axis line of the fixing roller 2. This elastically deforms part of the outer peripheral surface of the fixing roller 3, defining a given nip between both rollers. When a metallic film is used instead of the fixing roller 2, a nip may be formed on the film.

The fixing roller 2 rotates in the direction of an arrow at an approximately constant speed by means of a driving force supplied from a fixing motor 123 or a drum motor 121 which rotates the photosensitive drum 105. The pressure roller 3 is supplied with a given pressure from the pressurization mechanism 4 to touch the fixing roller 2. Accordingly, rotating the fixing roller 2 rotates the pressure roller 3 in the reverse direction of the fixing roller 2.

The pressure roller 3 touches the outer peripheral surface of the fixing roller 2 at a specified position called a nip. A release claw 5 is provided to release the paper P passing the nip from the fixing roller 2. The release claw 5 is positioned as specified near the nip at the downstream of the rotating direction of the fixing roller 2.

Around the fixing roller 2, there are provided at least two temperature detection elements 6*a* and 6*b*, a cleaner 7, and a heating error detection element 8 in order clockwise from the release claw 5.

The temperature detection elements 6*a* and 6*b* detect temperature on the outer peripheral surface of the fixing roller 2.

The temperature detection elements 6*a* and 6*b* are thermistors, for example. At least one thermistor is approximately centered on the roller 2 in a longitudinal direction.

The other of the temperature detection elements 6*a* and 6*b* is positioned at one end of the roller 2 in a longitudinal direction.

Each of the thermistors 6*a* and 6*b* is provided anywhere on the outer periphery of the roller 2, i.e., at a position where the phase viewed from the sectional direction is not subject to a specific condition. Obviously, it is possible to provide three or more thermistors.

The cleaner 7 removes toner or paper dust generated from the paper. The toner or paper dust may adhere to the fluorocarbon resin which has a specified thickness and is provided on the outer periphery of the fixing roller 2. The cleaner 7 also removes dirt or the like which floats in the apparatus and adheres to the fixing roller 2. The cleaner 7 includes a cleaning member and a support member which supports the cleaning member. The cleaning member is made of, e.g., a felt, a fur brush, or any other material whose contact with the fixing roller 2, if any, hardly damages the fluorocarbon resin layer. The cleaning member may rotate in contact with the surface of the fixing roller 2 or may be pressed against the outer peripheral surface of the fixing roller 2.

For example, a thermostat is used for the heating error detection element 8 to detect a heating error which causes the surface temperature of the fixing roller 2 to rise abnormally. When a heating error occurs, the heating error detection element 8 is used to prevent power supply to a heating coil (to be described).

The order and positions for arranging the temperature detection elements 6*a* and 6*b*, the cleaner 7, and the heating error detection element 8 are not limited to those indicated in FIG. 2.

On the periphery of the pressure roller 3, there are provided a release claw 9 to release the paper P from the pressure roller 3 and a cleaning roller 10 to remove toner applied to the outer peripheral surface of the pressure roller 3.

The inside of the fixing roller 2 is provided with an excitation coil 11 for generating an eddy current in the material of the roller 2. According to the example in FIG. 3, the excitation coil 11 includes a first coil 11*a* and a second coil 11*b*. The first coil 11*a* is positioned approximately at the center of the fixing roller 2 along its longer direction. The second coil 11*b* is provided near each end of the roller 2.

The second coil 11*b* is made of a wire having approximately the same resistivity and approximately the same sectional area (the number of strands) as those of the first coil 11*a*. The second coil 11*b* is formed by winding such wire for approximately the same number of turns as for the first coil 11*a*. The second coil 11*b* is arranged along the longer direction of the roller 2 and is positioned at each end of the roller 2 in the axial direction to sandwich the first coil 11*a*.

The second coil 11*b* can produce an output equivalent to that of the first coil 11*a* at two locations, i.e., both ends of the first coil 11*a*. In the description to follow, each part of the second coil 11*b* is referred to as a coil 11-1 or 11-2 when each part needs to be identified independently.

While the first coil 11*a* can heat near the center of the fixing roller 2 in the longitudinal direction, the second coil 11*b* is useful for heating near both ends of the fixing roller 2.

When, for example, an A4-size sheet of paper is transported so that its shorter side parallels the axial line of the fixing roller 2, the first coil 11*a* is formed to have enough length to heat the width of paper in contact with the outer peripheral surface of the roller 2.

The coils 11*a* and 11*b* of the excitation coil 11 are formed of a plurality of 0.5 mm diameter copper wires each insulated by heat-resistant polyamide-imide. In this example, each coil is formed of a Litz wire comprising a bundle of 16 such wires. The use of the Litz wire to form the excitation coil 11 enables the diameter of each wire to be smaller than the penetration depth of a skin effect occurring when a high-frequency alternating current is applied to the wire. Thus, it is possible to effectively apply a high-frequency current.

According to the example in FIG. 2, the coils 11*a* and 11*b* are fixed to a support member 12 via a coil supporter 13 formed of highly heat-resistant and insulative engineering plastics or ceramics. For the coil supporter 13, it is possible to use a PEEK (poly ether ether ketone) material, a phenol material, unsaturated polyester, etc., for example.

There is available any method of winding a wire to form the coils. By modifying the shape of the coil supporter 13, the flat excitation coil 11 may be formed to a shape that matches the inner circular periphery of the fixing roller 2.

In this embodiment, a ferrite core 14 is provided inside the coil to strengthen the magnetic flux. It may be preferable to use an air-core coil without using a core material such as ferrite, etc.

Figure 4:
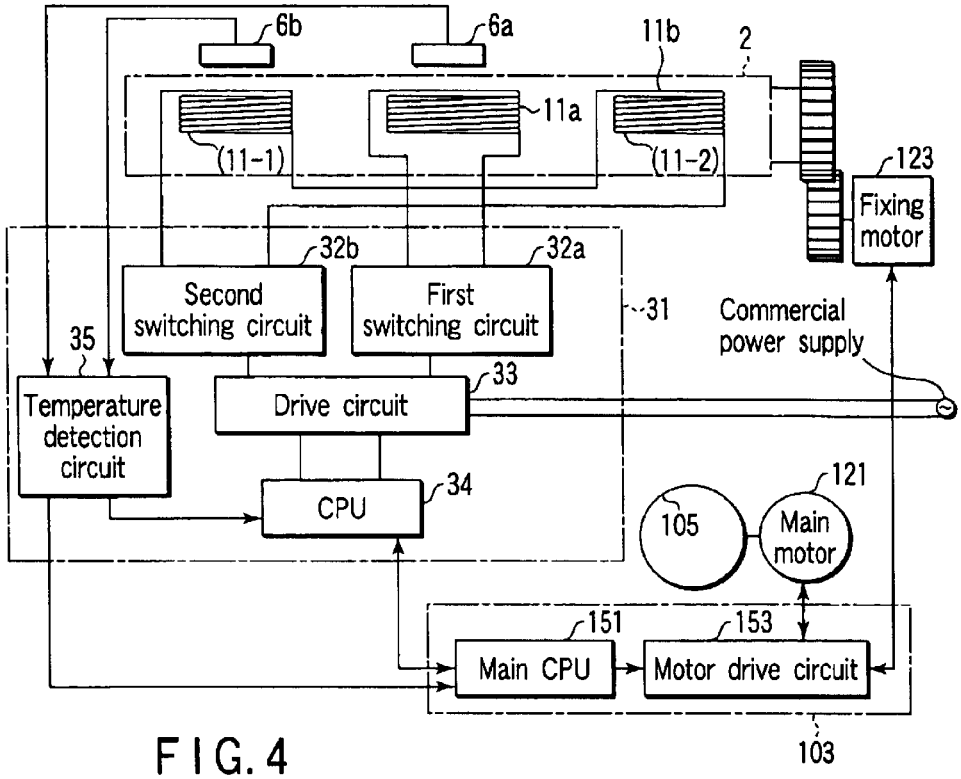
FIG. 4 is a block diagram illustrating an example of an excitation unit (fixing apparatus drive circuit) for driving the fixing apparatus in FIGS. 2 and 3.

FIG. 4 schematically shows an example of an excitation unit (excitation circuit) for driving the coils 11*a* and 11*b* of the excitation coil 11 as shown in FIGS. 2 and 3.

As shown in FIG. 4, the first coil 11*a* at the center is connected to a first switching circuit (inverter circuit) 32*a* of the excitation unit 31. The second coil 11*b* (including the coil 11-1 at one end and the coil 11-2 at the other end) is connected to a second switching circuit (inverter circuit) 32*b*.

In response to a control output from a drive circuit 33, the respective switching circuits 32*a* and 32*b* change the commercial power (AC power) frequency supplied from the outside to a specified frequency and supply the frequency to the respectively connected coils 11*a* and 11*b*. Accordingly, a specified electric power is independently or simultaneously supplied to the first and second coils 11*a* and 11*b* respectively connected to the switching circuits 32*a* and 32*b*. Obviously, the current applied to each coil changes at any time in accordance with a change of the time for enabling a switching element (transistor etc.)

Under control of a control CPU 34, the drive circuit 33 generates control output to the first and second switching circuits 32*a* and 32*b* so that the switching circuits 32*a* and 32*b* can generate the requested high-frequency output, i.e., inverter output with a specified frequency. The magnitude of high-frequency current supplied to coils varies with a change of the time for enabling the switching element to drive each coil. Accordingly, it is possible to set any magnitude of power supplied to each coil.

The first and second thermistors 6*a* and 6*b* detect the temperature near the center of the outer peripheral surface on the fixing roller 2 and temperature at both ends. A temperature detection circuit 35 converts the detected temperatures to temperature data (A/D converts). Based on the temperature data, the control CPU 34 sets high-frequency outputs to be generated from the first and second switching circuits 32*a* and 32*b* and supplies the outputs to the drive circuit 33.

Memory 36 capable of rewriting data previously stores the correspondence between temperature data and high-frequency output, the timing to drive the switching circuits 32*a* and 32*b*, etc. Data stored in the memory 36 can be freely rewritten according to power supply requirements for a country or a district where the copying apparatus 101 is installed or an allowable maximum value of power that can be supplied.

The following describes an example of first control for heating the outer peripheral surface of the fixing roller 2 to a specified temperature.

In the case of almost uniformly heating the entire area of the fixing roller 2 in the longitudinal direction (normal heating), for example, the first and second switching circuits 32*a* and 32*b* shown in FIG. 4 supply the respective coils 11*a* and 11*b* with output having a specified frequency (high-frequency output).

When the inverter circuits (first and second switching circuits 32*a* and 32*b*) are used, the power supplied to the coils 11*a* and 11*b* installed in the circuits depends on the magnitude of high-frequency current supplied to the coils. The magnitude of the high-frequency current is set based on the time for turning on the switching element, i.e., the ON time of the switching element. The magnitude of the current supplied to each coil is set based on the ON time of the switching element to be supplied to the inverter circuit. Namely, the magnitude of power supplied to each coil varies with the frequency determined by the ON time of the switching element and the time for turning off the switching element, i.e., the OFF time issued to the drive circuit 33 from the CPU 34. The power will be described as power to be output to the coils hereinafter.

Each of the coils 11*a* and 11*b* generates a magnetic flux having a specified direction according to the coil shapes and the magnitude of power supplied to the coils.

A change of the magnetic field generated by this magnetic flux is prevented by a magnetic flux and an eddy current occurring at a metallic part of the fixing roller 2. Accordingly, the metallic part of the fixing roller 2 generates Joule heat due to the eddy current and the resistance of the metallic part itself. The Joule heat heats the fixing roller 2, thus heating the paper P passing between the fixing roller 2 and the pressure roller 3 (see FIG. 2).

For example, the drive unit shown in FIG. 4 is used to supply the center excitation coil 11*a* with an output that produces 900 W power at the frequency of 25 through to 30 kHz. In this case, eddy currents are generated to heat the center of the fixing roller 2 in the longitudinal direction, increasing the temperature of the center or vicinity of the fixing roller 2 in the longitudinal direction to a specified temperature.

When the center coil 11*a* is not powered, the coil 11*b* at the end is also supplied with an output that produces 900 W power at the frequency of 25 through to 30 kHz, increasing the temperature at both ends of the roller 2 to a specified temperature.

Of course, when either coil is powered, the other coil is not powered.

The power supplied to coils has different upper bounds depending on countries and districts where the copying apparatus 101 is used. By changing frequencies up to an upper bound, the power can be changed within a range from 700 to 1300 W.

There is a warm-up period after the copying apparatus 101 is turned on until the surface temperature of the fixing roller 2 in the fixing apparatus 1 reaches a temperature capable of fixing. During the warm-up period, the control CPU 34 in the excitation unit 31 directs the drive circuit 33 to supply a specified power. This drives the first switching circuit 32*a* to supply the specified power to the center coil 11*a*. The coils b at the ends are not powered until a specified temperature is reached on the surface of the fixing roller 2 heated by the magnetic flux from the center coil 11*a*. Namely, the second switching circuit 32*b* remains OFF because of no drive output from the drive circuit 33 under control of the CPU 34.

The first and second thermistors 6*a* and 6*b* always monitor the surface temperature of the fixing roller 2. The monitor output is converted (A/D converted) in the temperature detection circuit 35 and is input to the CPU 34.

Figure 5:
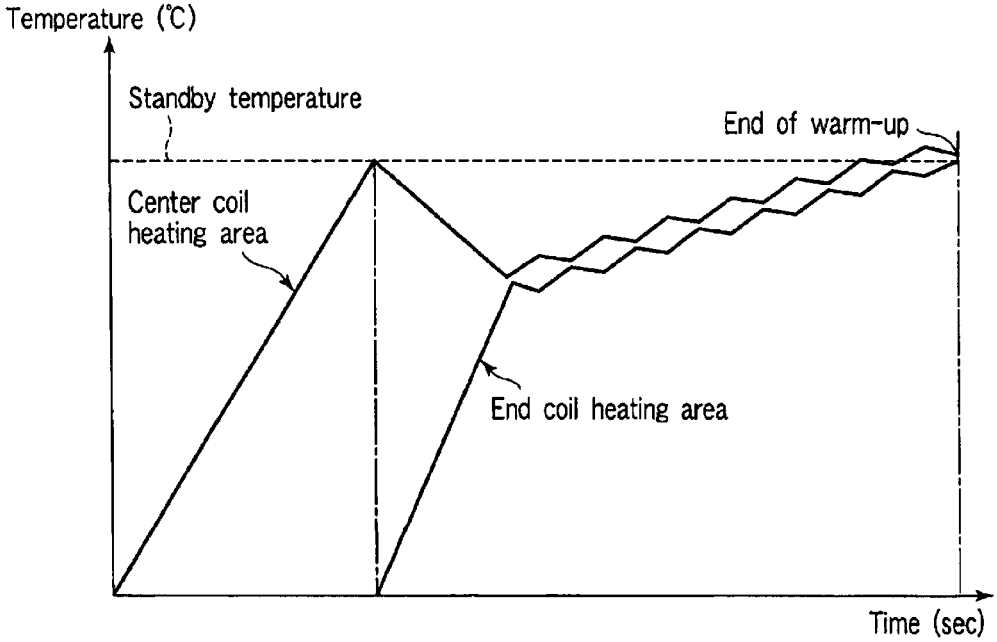
FIG. 5 is a graph for explaining temperature rise characteristics at startup (power-on sequence initiation) of a fixing roller heated through the use of the fixing apparatus drive circuit as shown in FIG. 4.

When the thermistor 6*a* detects that the temperature at the center of the roller 2 reaches the specified temperature, this state is notified to the CPU 34 via the temperature detection circuit 35. According to a control pattern already stored in the memory 36, control is provided to stop power supply to the center coil 11*a*, i.e., a drive output to the first switching circuit 32*a* from the drive circuit 33 as shown in FIG. 5. At a specified timing, the drive circuit 33 then generates a specified drive output to the second switching circuit 32*a*.

Consequently, the specified power is supplied to the coil 11*b* provided at both ends of the roller 2. In many cases, the electrical energy supplied to the coil 11*b* is the same as that so far supplied to the center coil 11*a*. The description to follow covers timing for switching the power between the coils 11*a* and 11*b* and special control for the power switching.

The specified power is applied to the coil b at both ends of the coil 2 to heat both ends of the fixing roller 2 to a specified temperature. Since no power is supplied to the coil 11*a* at this time, the temperature at the center of the fixing roller 2 gradually decreases. The time needed to heat both ends of the fixing roller 2 to a specified temperature is shorter than the time needed to heat the center of the roller 2 to the same specified temperature.

While the temperature increases at both ends of the fixing roller 2, heat conduction (diffusion) occurs from the center (of the roller 2) already heated to the specified temperature to both ends. Even when the same power is supplied to the respective coils, the time needed to heat both ends of the roller 2 shortens.

The temperature at both ends of the roller 2 increases because the coil 11*b* at the end is powered. The temperature at the heated center of the roller 2 decreases because the power supplied to the coil is cut. These temperatures reach approximately the same temperature as shown in FIG. 5. At this point, a specified power is then alternately applied to the coil 11*a* used to heat the center of the roller 2 and the coil 11*b* used to heat both ends thereof.

Thereafter, the specified power is alternately applied to the coils 11*a* and 11*b* (for alternately driving the coils 11*a* and 11*b*) until each of the first and second thermistors 6*a* and 6*b* detects the temperature that has reached 200° C., for example.

All coils may be driven simultaneously during the warm-up period and the normal operation. When driving all coils simultaneously, however, it is necessary to provide a power detection mechanism capable of detecting the power supplied to the coils 11*a* and 11*b* independently. This is the cause of increasing costs of the fixing apparatus (image forming apparatus). Accordingly, during the warm-up period and the normal operation, it is preferable to supply the power to only either coil, not to power all coils simultaneously. Namely, it is preferable to alternately drive one of the coils, not to drive all coils simultaneously.

When the coils 11*a* and 11*b* are alternately supplied with specified outputs (powers), a large difference between magnitudes of the outputs (powers) supplied to the coils 11*a* and 11*b* causes different frequencies for turning on or off the switching element.

Namely, a large difference between magnitudes of the outputs (powers) supplied to the coils 11*a* and 11*b* causes different high-frequency current frequencies.

For this reason, as mentioned above, an impulsive sound (interference sound) may occur between the coil and the roller. When there is a case of alternately driving the coils supplied with outputs having different magnitudes, the voltage greatly fluctuates each time the coils are switched. This may cause a flicker etc. Accordingly, it is preferable to provide approximately the same power to the center coil 11*a* and the coil 11*b* at the end.

However, a difference may occur between the power supplied to the center coil and that supplied to the coil at the end making it impossible to approximately equalize the two power magnitudes. When a maximum suppliable power is 1,500 W, for example, it is preferable to keep a difference between two powers up to 200 W. It is allowed to increase a difference between powers supplied to respective coils unless flickering light is irradiated from the lighting equipment, especially a fluorescent lamp etc. placed near a position where the copying apparatus is installed or a switching noise is generated from a stabilizer used for the fluorescent lighting equipment.

Figure 6:
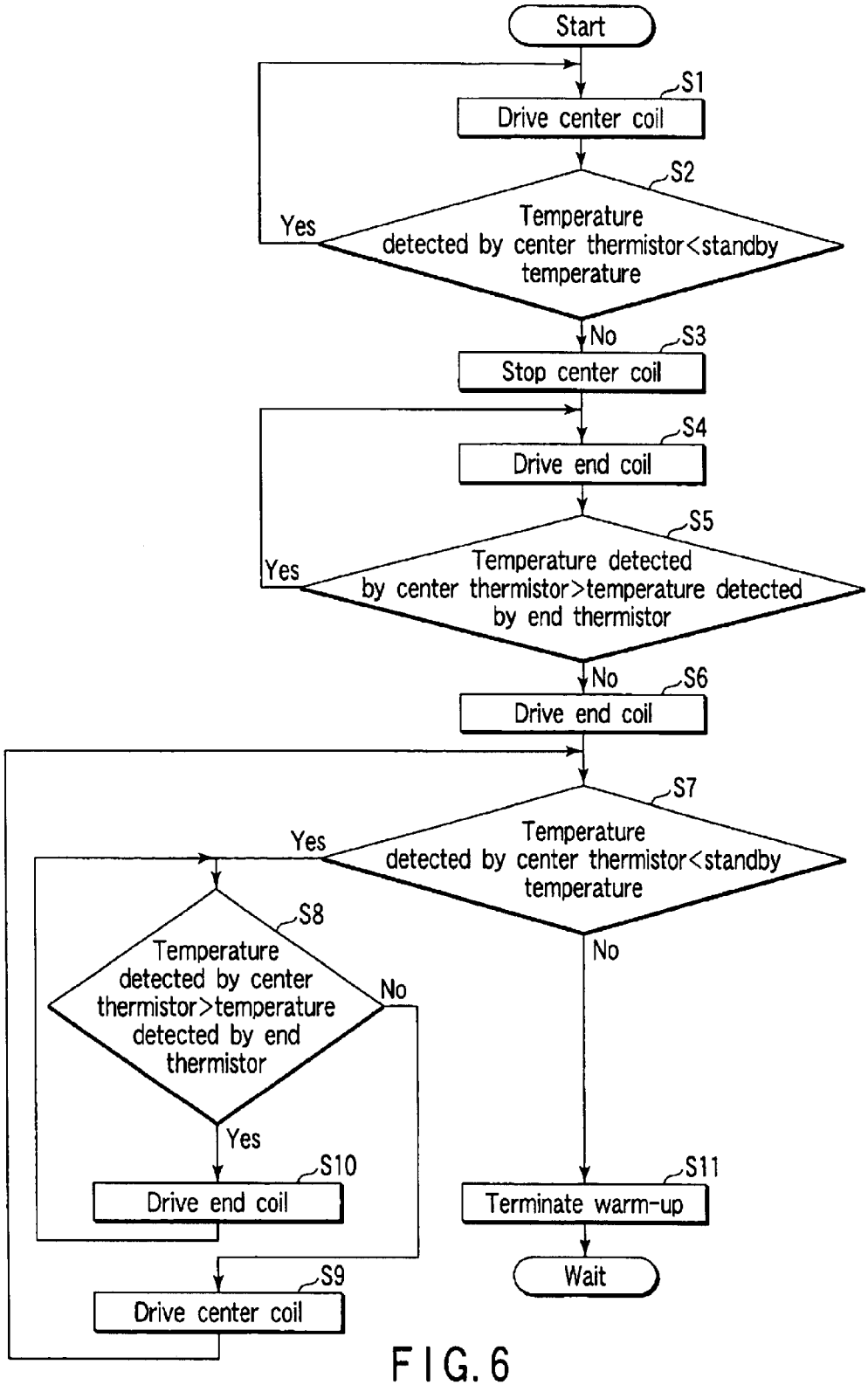
FIG. 6 is a flowchart for explaining an example of control at startup (power-on sequence initiation) for raising the roller temperature through the use of the fixing apparatus drive circuit as shown in FIG. 4.

FIG. 6 is a flowchart for explaining in more detail an example of controlling the excitation unit which enables heating of the fixing roller shown in FIG. 5.

During the warm-up for heating the surface of the fixing roller 2 of the fixing apparatus 1 to a temperature capable of fixing, a specified power is first applied to the coil 11*a* for heating the center of the roller 2 (S1).

Thereafter, turning on electricity for (supplying power to) the center coil 11*a* continues (S2, S2-Yes) until the temperature at the center of the roller 2 becomes higher than 180° C., for example. The first thermistor 6*a* always monitors the temperature of the roller 2 and notifies the CPU 34 of the temperature via the temperature detection circuit 35.

When an output from the first thermistor 6*a* shows that the temperature of the roller 2 reaches 180° C. or more at step S2 (S2-No), the power supply to the coil 11*a* stops temporarily (S3). In order to heat both ends of the roller 2, the end coil 11*b* is supplied with the power having approximately the same magnitude of the power so far supplied to the coil 11*a* (S4).

Thereafter, the power supply to the coil 11*b* continues until the temperature at both ends of the roller 2 becomes the temperature at the center of the roller 2 (S5, S5-Yes). The second thermistor 6*b* always monitors the temperature of the roller 2 and notifies the CPU 34 of the temperature via the temperature detection circuit 35.

As mentioned above, the time needed to heat both ends of the fixing roller 2 becomes shorter than the time for heating the center even if the power supplied to the coil 11*b* is the same as that supplied to the coil 11*a*.

Namely, heat conduction (diffusion) occurs from the center to the both ends to slightly heat the both ends. This heat can be also used for heating the both ends.

When the temperature at both ends of the roller 2 becomes higher than the temperature at the center of the roller 2 at step S5 (S5-No), the process stops supplying the coil 11*b* with the electricity (power) for heating the both ends of the coil (S6).

When the process stops supplying the coil 11*b* with the electricity for heating the both ends of the coil at step S6, it is determined whether the temperature detected by the thermistor 6*a* at the center of the roller 2 reaches a standby temperature, e.g., 180° C. (S7). As will be described later, the warm-up terminates when the temperature at the both ends reaches the standby temperature and the center maintains the standby temperature.

If the temperature detected by the thermistor 6*a* at the center of the roller 2 does not reach 180° C. at step S7 (S7-Yes), the temperature at the both ends of the roller 2 is compared to the temperature at the center of the roller 2 (S8).

At step S8, it is determined whether the temperature at the center of the roller 2 is lower than the temperature at the both ends of the roller 2 (S8-No) or the temperature at the center of the roller 2 is higher than the temperature at the both ends of the roller 2 (S8-Yes).

Subsequently, the specified drive current is supplied to the coil capable of heating the lower-temperature side (S9, S10), i.e., the center or the both sides of the roller 2.

The routine in FIG. 6 has explained the example of detecting that the temperature at the center reaches the standby temperature, then increasing the temperature at the both ends. It is possible to use any other method of equalizing temperatures at the center and the both ends.

Namely, the routines at steps S7 through S10 are combined to alternately drive the coil for heating the both ends and the coil for heating the center.

In this manner, the warm-up continues until the temperature at the center finally reaches the standby temperature, i.e., 180° C. while the temperature along the longitudinal direction of the fixing roller 2 is heated to a specified uniform temperature. This can evenly increase the temperature in the longitudinal direction of the fixing roller 2 to a specified standby temperature across the entire area of the roller 2.

As mentioned above, when the coil 11*a* heats the center of the roller 2, the generated heat diffuses to the end of the roller 2 due to the heat conduction of the roller itself. The heat diffusing from the center to the end of the roller 2 is approximately settled within an area of the roller 2 heated by the coil 11*b*.

The above-mentioned examples simultaneously heat the full length of the fixing roller 2 (by simultaneously applying high-frequency output with a specified frequency to all coils) or equally apply a drive current to the coils 11*a* and 11*b*. Compared to these examples, first heating the center of the roller 2 can heat the full length of the roller 2 to a specified temperature with small power consumption in a short time.

The example of the embodiment as shown in FIGS. 4 to 6 first heats the center of the fixing roller 2 to the temperature as high as 180° C. It is possible to set an optimal temperature according to the metallic material, thickness, thermal conductivity, etc. of the roller 2, the magnetic flux generated from the coils 11*a* and 11*b*, etc. For example, the temperature may be 200° C. or 170° C.

As mentioned above, the inside of the fixing roller 2 is provided with a plurality of excitation coils along the longer direction of the roller 2 such as the coil 11*b* at one end, the coil 11*a* at the center, and the coil 11*b* at the other end. In this case, the conventional heating (control) method generally supplies a specified power to the coil capable of heating a low-temperature part of the roller. The temperature, if increased, easily decreases at the roller's end because it touches a bearing rotatably supporting the roller 2, a metallic member supporting the bearing, etc. When the respective coils evenly heat the roller along the longer direction, much heat is diffused somewhere other than the roller.

According to the embodiment of the present invention, by contrast, the center coil 11*a* is supplied with a specified power to first heat the center of the roller 2. In this case, the heat increased at the center of the roller 2 is partially diffused to both ends of the roller due to heat conduction. While this naturally decreases the temperature at the center of the roller 2, the temperature at both ends of the roller increases.

The heat conduction transfers the heat to the end of the roller 2. This heat is useful for shortening the time for heating the roller's ends.

When the coil 11*b* at the end heats both ends of the roller 2, the heat is diffused somewhere other than the roller.

However, this method shortens the time needed to heat the entire area of the roller 2 along the longer direction. Accordingly, the total amount of heat lost due to the diffusion is relatively small compared to the known control method of equally heating the entire area of the roller along the longer direction.

Figure 7:
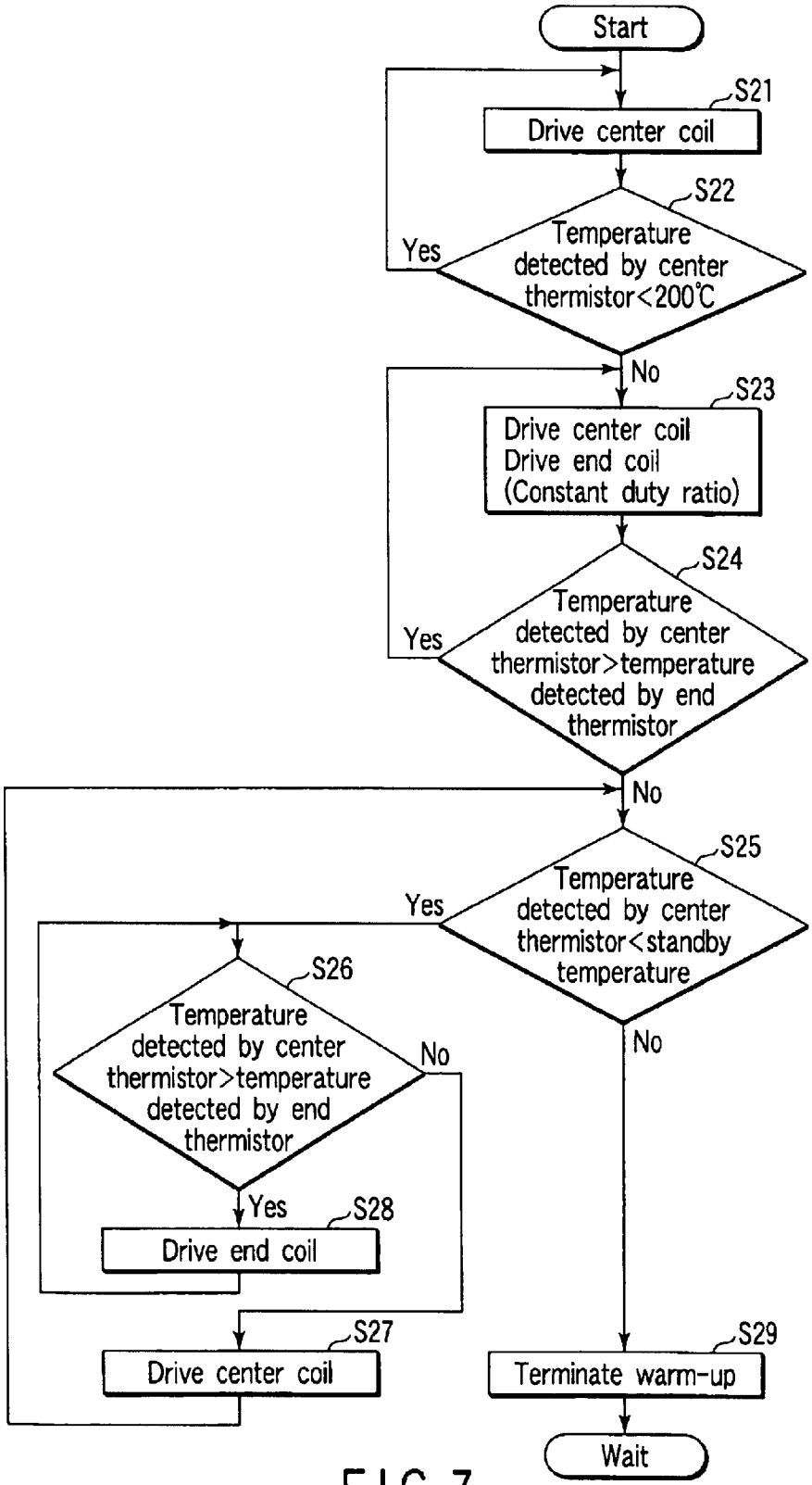
FIG. 7 is a flowchart for explaining another example of warm-up control different from an embodiment shown in FIGS. 4 to 6.

FIG. 7 is a flowchart for explaining another example of controlling the warm-up differing from the embodiment as shown in FIGS. 4 to 6.

As shown in FIG. 7, a specified power is first applied to the center coil 11*a* (S21). Then, the power supply to the coil 11*a* continues until the temperature at the center of the fixing roller 2 reaches a temperature (e.g., 200° C.) higher than or equal to the standby temperature (S22, S22-Yes). The first thermistor 6*a* always monitors the temperature at the center of the fixing roller 2 and notifies the CPU 34 of the temperature via the temperature detection circuit 35.

When an output from the first thermistor 6*a* shows that the temperature of the roller 2 reaches 200° C. or more at step S22 (S22-No), a specified power is supplied to the coils 11*a* and 11*b* alternately. In this case, each coil is supplied with the power at the following ratio (duty) for example.

Coil 11*a*:coil 11*b*=1:1

Subsequently, the coils 11*a* and 11*b* are supplied with the specified power having the fixed duty until the temperature at the both ends of the roller 2 becomes higher than the temperature at the center of the roller 2 (S24, S24-Yes).

When the process detects at step S24 (S24-No) that the temperature at both ends of the roller 2 becomes higher than the temperature at the center of the roller 2, it is determined whether or not the temperature at the center of the roller 2 approximately reaches, e.g., 180° C. (S25).

As will be described later, the warm-up terminates when the temperature at the both ends reaches the standby temperature and the center maintains the standby temperature (S29).

If the temperature detected by the thermistor 6*a* at the center of the roller 2 does not reach 180° C. at step S25 (S25-Yes), the temperature at the both ends of the roller 2 is compared to the temperature at the center of the roller 2 (S26).

At step S26, it is determined whether the temperature at the center of the roller 2 is lower than the temperature at the both ends of the roller 2 (S26-No) or the temperature at the center of the roller 2 is higher than the temperature at the both ends of the roller 2 (S26-Yes).

Subsequently, the specified drive current is supplied to the coil capable of heating the lower-temperature side (S27, S28), i.e., the center or the both sides of the roller 2. The routine in FIG. 8 has explained the example of detecting that the temperature at the center reaches the standby temperature, then increasing the temperature at the both ends. It is possible to use any other method of equalizing temperatures at the center and the both ends. Namely, the routines at steps S25 through S28 are combined to alternately drive the coil for heating the both ends and the coil for heating the center.

In this manner, the warm-up continues until the temperature at the center finally reaches the standby temperature, i.e., 180° C. while the temperature along the longer direction of the fixing roller 2 is heated to a specified uniform temperature. This can evenly increase the temperature in the longitudinal direction of the fixing roller 2 to a specified standby temperature across the entire area of the roller 2.

Figure 8:
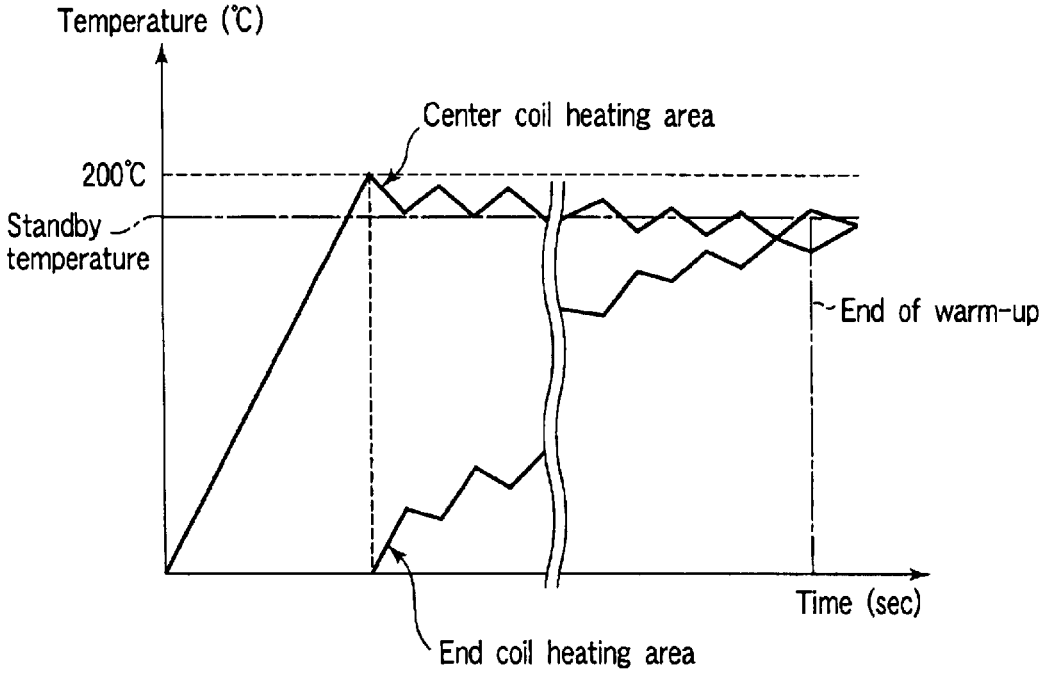
FIG. 8 is a graph for explaining the relationship between the time and the fixing roller's temperature rise based on the warm-up control shown in FIG. 7.

FIG. 8 schematically shows a process of heating the center and both ends of the roller 2 according to the warm-up control shown in FIG. 7.

As shown in FIG. 8, a specified power is supplied to the coil 11*a* capable of heating the center until the temperature at the center of the roller 2 reaches a specified temperature.

After the temperature at the center of the roller 2 reaches the specified temperature, a specified power is alternately supplied to the coil 11*a* and the coil 11*b* until the temperature at the center of the roller 2 becomes equal to that at both ends thereof. At this time, a specified duty is maintained. The coil 11*a* can heat the center of the roller 2. The coil 11*b* can heat the both ends thereof.

When one coil is supplied with a specified power, the remaining coils are not supplied with the power. An alternate drive control is used for all coils without supplying the power simultaneously. This makes it possible to reduce the power consumption and shorten the time needed for the warm-up.

Figure 9:
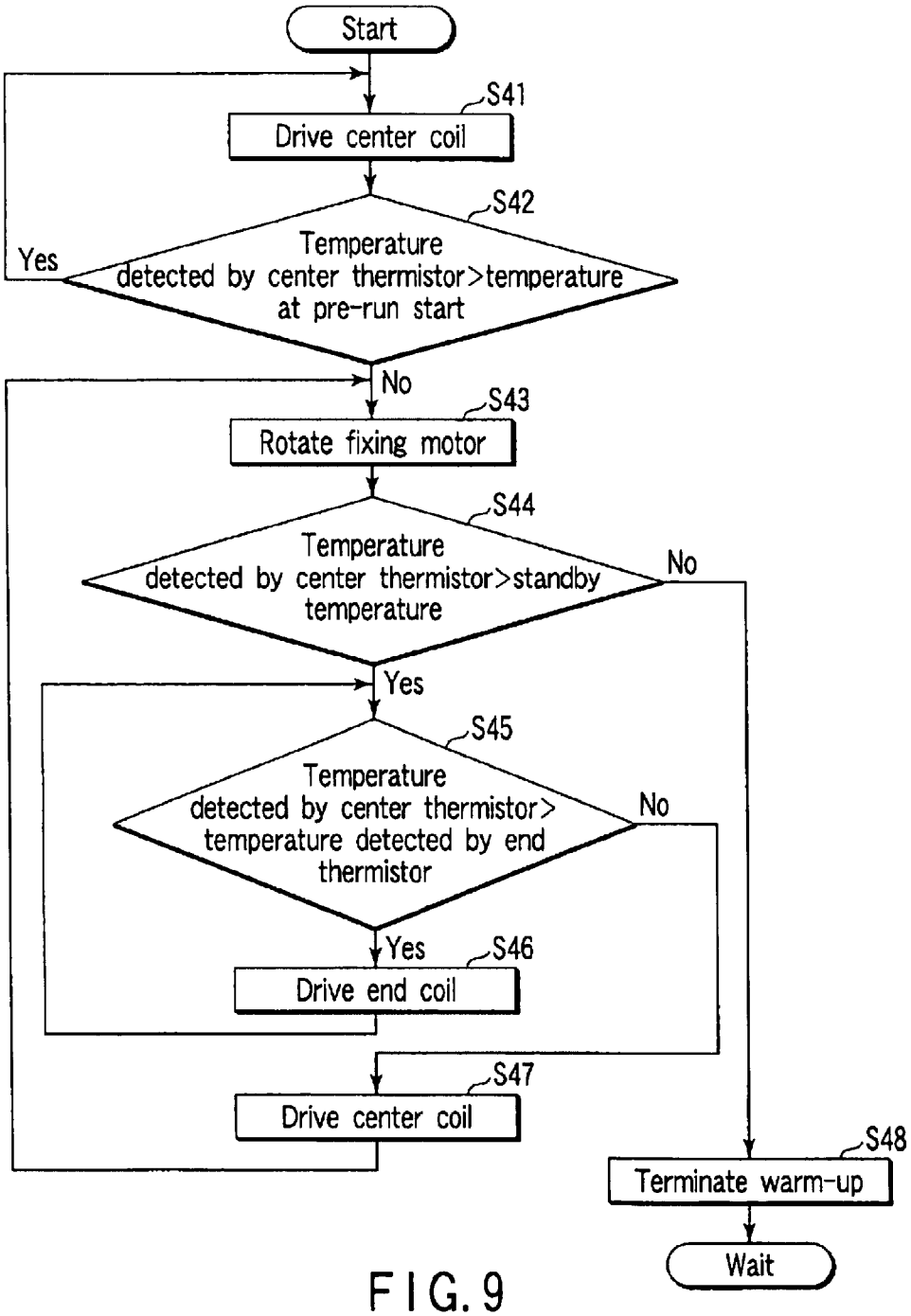
FIG. 9 is a flowchart for explaining another example of warm-up control different from the embodiment shown in FIGS. 4 to 8.

FIG. 9 is a flowchart for explaining yet another example of controlling the warm-up differing from the embodiment as shown in FIGS. 4 to 8.

A specified output is supplied to the coil 11*a* for heating the center of the fixing roller 2 (S41).

Subsequently, the specified output is constantly supplied to the coil 11*a* until the first thermistor 6*a* detects that the surface temperature of the roller 2 reaches a specified temperature lower than the standby temperature (S42, S42-YES).

When the surface temperature of the fixing roller 2 reaches the specified temperature, e.g., 100° C. (S42-No), the fixing motor 123 rotates under control of a main CPU 151 in the image forming section 103 to rotate the roller 2 at a specified speed (S43).

When the fixing motor 123 is not installed independently, a transmission mechanism (not shown) transmits the torque of the main motor 121 for rotating the photosensitive drum 105 to the fixing roller 2.

When the roller 2 rotates, the pressure roller 3 rotates in accordance with the roller 2, considerably decreasing the surface temperature of the roller 2. The heat at the heated center of the fixing roller 2 itself is diffused to both ends of the roller due to the roller's heat conduction.

Likewise as shown in FIG. 6 or 7, the respective coils 11*a* and 11*b* are supplied with the power of a specified magnitude alternately or with the power having a fixed duty until the temperature at both ends of the roller 2 becomes higher than the temperature at the center thereof (S44, S44-Yes).

If it is detected at step S44 that the temperature at both ends of the roller 2 becomes higher than the temperature at the center thereof (S44-No), it is determined whether or not the temperature at the center of the roller 2 reaches 180° C. (S45). Of course, the warm-up terminates when the temperature at the both ends reaches the standby temperature and the center maintains the standby temperature (S48).

If the temperature detected by the thermistor 6*a* at the center of the roller 2 does not reach 180° C. at step S45 (S45-Yes), the temperature at the both ends of the roller 2 is compared to the temperature at the center of the roller 2 (S45).

At step S45, it is determined whether the temperature at the center of the roller 2 is lower than the temperature at the both ends of the roller 2 (S45-No) or the temperature at the center of the roller 2 is higher than the temperature at the both ends of the roller 2 (S45-Yes).

Subsequently, the specified drive current is supplied to the coil capable of heating the lower-temperature side (S46, S47), i.e., the center or the both sides of the roller 2. The routine in FIG. 8 has explained the example of detecting that the temperature at the center reaches the standby temperature, then increasing the temperature at the both ends. It is possible to use any other method of equalizing temperatures at the center and the both ends. Namely, the routines at steps S44 through S47 are combined to alternately drive the coil for heating the both ends and the coil for heating the center. In this manner, the warm-up continues until the temperature at the center finally reaches the standby temperature, i.e., 180° C. while the temperature along the longer direction of the fixing roller 2 is heated to a specified uniform temperature. This can evenly increase the temperature in the longitudinal direction of the fixing roller 2 to a specified standby temperature across the entire area of the roller 2.

The warm-up allows the fixing roller 2 and the pressure roller 3 to maintain temperatures relatively lower than the temperature capable of fixing the toner on the paper P. During the warm-up, approximate control is provided to supply powers to the coils 11*a* and 11*b* by rotating the both rollers. When the temperature at the center of the roller 2 reaches a specified temperature, e.g., 180° C., the power is supplied to the coils 11*a* and 11*b* alternately so that the temperature at the end of the roller 2 becomes 180° C., namely, the uniform roller temperature can be generated over the entire area of the roller 2 in the longitudinal direction.

This method can shorten the time required for the warm-up compared to the previous embodiment shown in FIGS. 4 to 8.

The drive method shown in FIG. 9 alternately applies output of a specified frequency to each of the coils 11*a* and 11*b* at a time point when one of the first and second thermistors 6*a* and 6*b* detects that the temperature of the roller 2 reaches the specified temperature. For example, the respective thermistors 6*a* and 6*b* may be used for detecting an abnormal temperature rise (or no temperature rise due to a disconnected coil wire) during a specified time period from the start of supplying the power. After the roller 2 rotates and the roller 3 rotates in interlock with the roller 2, a period of time passes until at least one thermistor detects that either the center or both ends of the roller 2 reach the specified temperature. During this period, rough control may be provided for output to be supplied to each of the coils 11*a* and 11*b* compared to the other examples explained previously.

Namely, the first embodiment of the present invention is best characterized in that the respective coils may be powered alternately at any timing during heating if it is possible to uniform the surface temperature of the fixing roller 2 in the longitudinal direction at termination of the warm-up.

Figure 10:
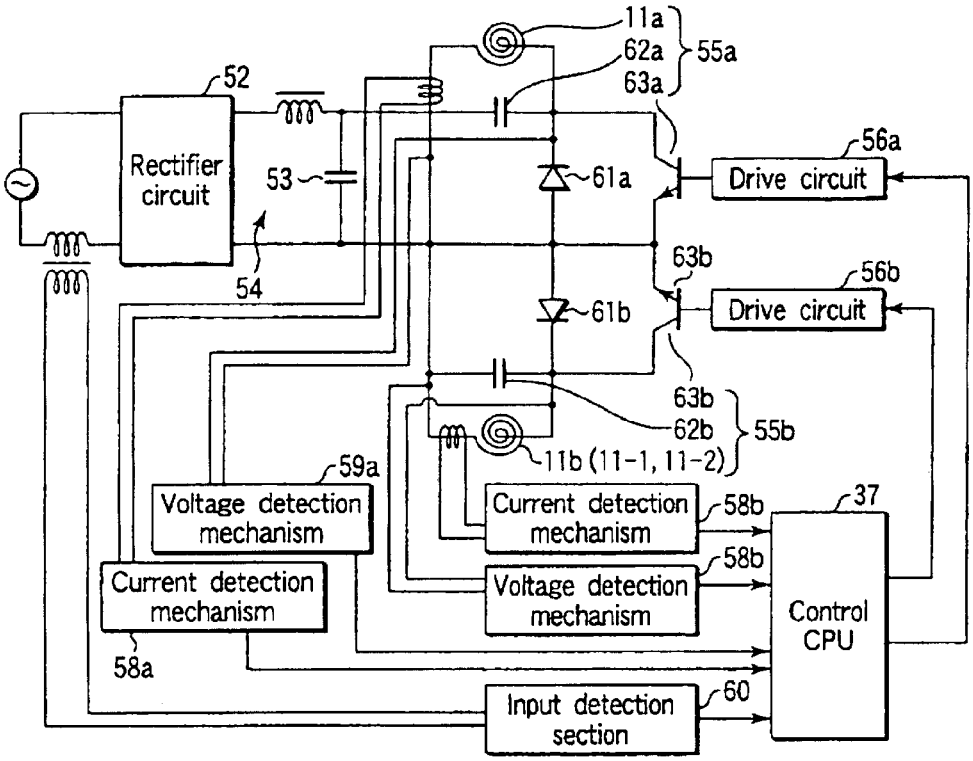
FIG. 10 schematically shows another example of the excitation unit different from the one shown in FIG. 4.

FIG. 10 schematically shows another example of the excitation unit differing from the embodiment shown in FIG. 4. When using the excitation unit in FIG. 10, it is possible to use a fixing apparatus similar to that shown in FIG. 1. A detailed description about the fixing apparatus is omitted hereinafter. The mutually corresponding configurations in FIG. 4 is designated by the same reference numerals and a detailed description is omitted for simplicity.

Like the excitation unit described in FIG. 4, the excitation unit 51 in FIG. 10 includes a rectifier circuit 52 and a smoothing capacitor 53. The rectifier circuit 52 rectifies an AC voltage from the commercial power supply. The smoothing capacitor 53 smoothes output from the rectifier circuit. The rectifier circuit 52 and the smoothing capacitor 53 are generically referred to as a power supply section 54.

A terminal voltage of the smoothing capacitor 53 passes reversely connected diodes 61*a* and 61*b*. Each time the polarity of the input AC voltage is inverted, the terminal voltage of the smoothing capacitor 53 is distributed to the coils 11*a* and 11*b*. The coil 11*a* can heat the center of the roller 2 connected to both ends of a resonance capacitor 62*a*. The coil 11*b* can heat both ends of the roller 2 connected to both ends of the resonance capacitor 62*b*.

The diodes 61*a* (61*b*), the resonance capacitor 62*a* (62*b*), and the switching element 63*a* (63*b*) respectively function as a known inverter circuit 55*a* (55*b*) provided with the corresponding coil 11*a* or 11*b*.

The neutral point side of the smoothing capacitor 53 connects with first and second drive circuits 56*a* and 56*b* which respectively supply specified powers to the coils 11*a* and 11*b* via the switching elements 63*a* and 63*b*. The drive circuits 56*a* and 56*b* are connected to a control CPU 57.

At least one of the inverter circuits 55*b* and 55*a* connects with a current detection mechanism 58*b* (58*a*) and a voltage detection mechanism 59*b* (59*a*). The current detection mechanism 58*b* (58*a*) detects the magnitude of current flowing through the corresponding inverter circuit and notifies the CPU 57 of the detected current magnitude. The voltage detection mechanism 59*b* (59*a*) detects and notifies a terminal voltage of the coil 11*a* or 11*b* for the corresponding inverter circuit. The CPU 57 is also supplied with a detection result from an input detection mechanism 60 which monitors operations of the power supply section 54.

The warm-up starts when a power switch (not shown) of the copying apparatus 101 is turned on. In many cases, during a specified time period immediately after the warm-up, most of the power suppliable to the copying apparatus 101 is only supplied to the coils 11*a* and 11*b* for heating the fixing roller 2 of the fixing apparatus 1.

For this reason, the excitation unit as shown in FIG. 10 uses a control circuit which can independently, alternately, or simultaneously supply power to each of the coils 11*a* and 11*b*. Exclusively during a specified time period immediately after the warm-up (turning the power on) starts, it is possible to intensively supply the coils 11*a* and 11*b* of the fixing apparatus 1 with large electric power (high-frequency input with a specified frequency) approximate to the maximum electric power suppliable to the copying apparatus 101. When the coils 11*a* and 11*b* are simultaneously powered, the first and second drive circuits 56*a* and 56*b* simultaneously supply a specified output (electric power) to the coils 11*a* and 11*b* under control of the CPU 57 within a range in which the maximum power does not exceed the suppliable power.

As will be described later with reference to FIG. 11, for example, the copying apparatus 101 is turned on (S61). At this point, a specified power is supplied to the coils 11*a* and 11*b* so that the sum of powers supplied to these coils becomes approximately equal to the maximum power suppliable to the copying apparatus 101.

Until either of the first and second thermistors 6*a* and 6*b* detects that the surface temperature of the fixing roller 2 increases to a specified temperature, the coils 11*a* and 11*b* are supplied with a specified power continuously (S63-No, S62). The specified power is equivalent to the sum of powers supplied to the coils 11*a* and 11*b* and approximately equals the maximum input power suppliable to the copying apparatus 101.

Either of the first and second thermistors 6*a* and 6*b* detects that the surface temperature of the fixing roller 2 has increased to the specified temperature (S63-Yes). Then, a specified power is supplied to the coil 11*a* or 11*b* capable of heating around the thermistor having a lower temperature.

Like the example described with reference to FIG. 8, the specified power is hereafter supplied to the coil 11*a* capable of heating the center until the temperature at the center of the roller 2 reaches the specified temperature. After the temperature at the center of the roller 2 reaches the specified temperature, the specified power is alternately supplied to the coil 11*b* capable of heating both ends of the roller 2 and the coil 11*a* capable of heating the center of the roller 2. This operation continues until the same temperature is measured at the center and the both ends of the roller 2 (S64, S65).

Figure 12:
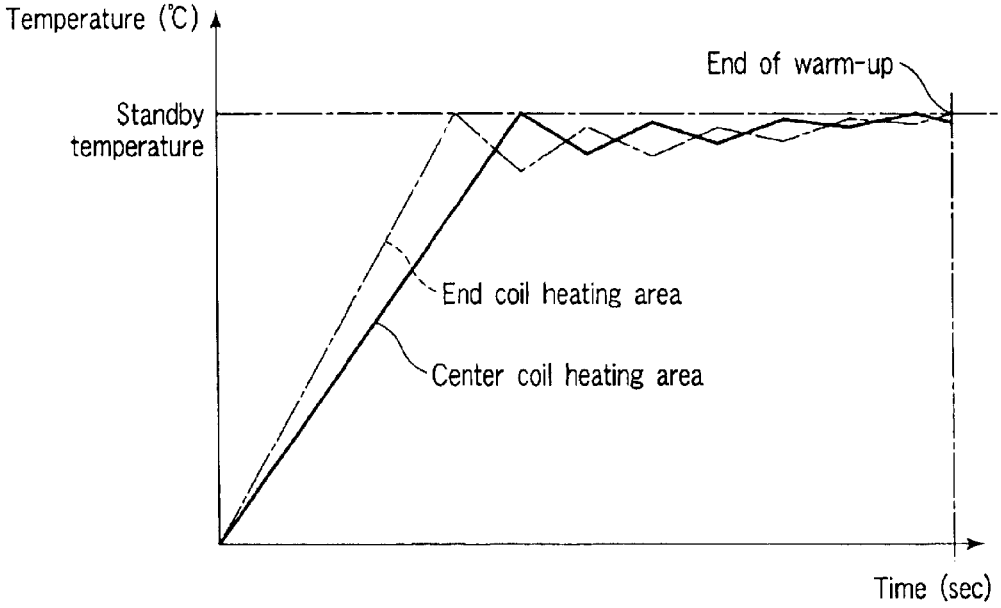
FIG. 12 is a graph for explaining the relationship between the time and the fixing roller's temperature rise based on the excitation unit shown in FIG. 10 and the warm-up control shown in FIG. 11.

Then, as shown in FIG. 12, the specified power is alternately supplied to the coil 11*a* or 11*b* which can heat the low-temperature part of the fixing roller 2. This operation continues until the surface temperature of the fixing roller 2 is increased to the specified temperature at the center and the both ends (S65, S65-No).

Accordingly, it is possible to shorten the warm-up time for heating the fixing roller 2 of the fixing apparatus 1, and the maximum power suppliable to the copying apparatus 101 can ensure power consumed by the main motor 121 for rotating the photosensitive drum 105 and/or the developing apparatus 107 in the image forming section 103 and by the fixing motor 123 for rotating the fixing roller 2 at that, for example.

Figure 11:
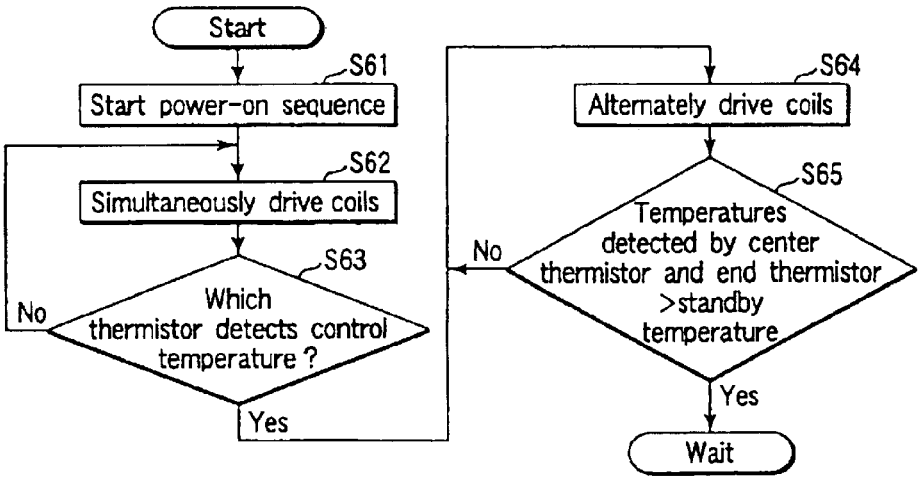
FIG. 11 is a flowchart for explaining an example of temperature control applicable to the excitation unit shown in FIG. 10.

More specifically, the main motor 121, the fixing motor 123, etc. do not operate at step S61 in FIG. 11 (when the copying apparatus 101 is turned on). If the maximum suppliable power is 1,500 W, the coils 11*a* and 11*b* can be provided with a high-frequency output approximately equivalent to the power of 1,400 W. When the system can supply the above-mentioned maximum suppliable power of 1,500 W, the coils 11*a* and 11*b* can be supplied with the maximum power of, e.g., 1,000 W during a normal operation (image formation). For example, steps S61 to S63-No are also applicable to a case where no image formation operation occurs after the warm-up, or no image formation state continues after completion of any image formation operation, and the copying apparatus 101 in the preheating (power saving) mode returns to a normal state. Many excitation units using the inverter circuit may drive the coils 11*a* and 11*b* simultaneously. In such case, powers supplied to the coils 11*a* and 11*b* are controlled for feedback based on the magnitude of current flowing through these coils and the magnitude of voltage applied to both ends of the coil 11*a* or 11*b*.

By contrast, the embodiment according to the present invention uses the input detection mechanism 60 to detect the total electrical energy simultaneously supplied to the coils 11*a* and 11*b*, thus detecting the power supply voltage and current before rectification. The input detection mechanism 60 obtains the maximum electrical energy suppliable to the coils 11*a* and 11*b*. This prevents the copying apparatus 101 from stopping due to an excess of the input electrical energy supplied to the coils 11*a* and 11*b* over the rated power suppliable to the copying apparatus 101.

The electrical energy signifies the current flowing through the coils 11*a* and 11*b* and the voltage applied to both ends thereof. It is possible to calculate the electrical energy based on the current flowing through the corresponding coil (current flowing through the capacitor 62*b* (62*a*)) detected by the current detection mechanism 58*b* (58*a*) and the voltage at the both ends detected by the voltage detection mechanism 59*b* (59*a*).

Figure 13:
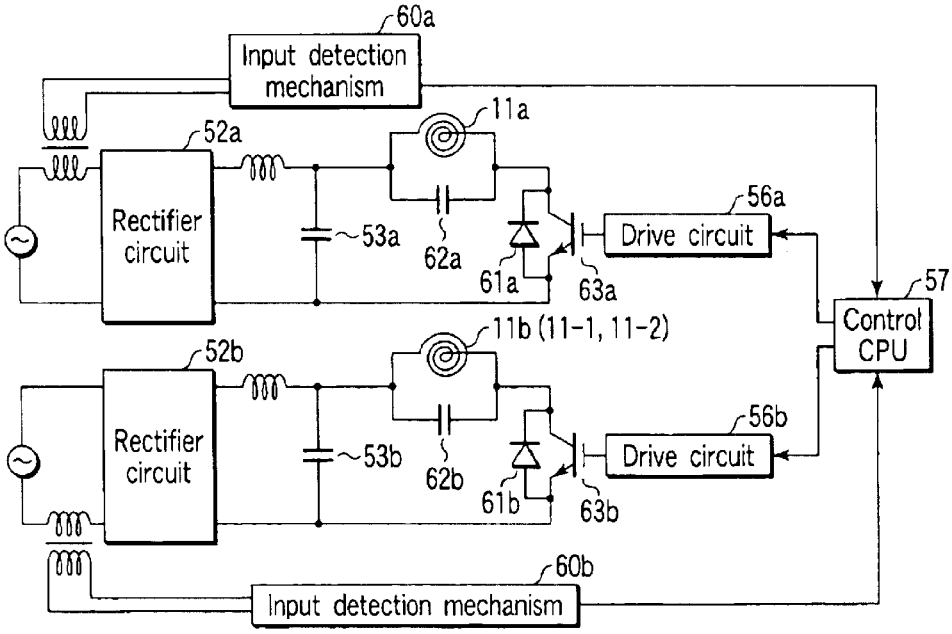
FIG. 13 schematically shows an example of an embodiment by modifying the excitation unit in FIG. 10.

According to the embodiment shown in FIG. 10, the power supply section 54 is shared by the coils 11*a* and 11*b*. As shown in FIG. 13, it is obvious that power supply sections 54*a* and 54*b* may be independently provided for the respective coils. In this case, input powers supplied to the coil and the coil pair can be detected by using input detection mechanisms 60*a* and 60*b* to detect the power voltage and current of the power supply sections 54*a* and 54*b* before rectification. At this time, outputs from the coils 11*a* and 11*b* can be found from the sum of the input powers detected by the input detection mechanism 60*a* and 60*b*.

Considering an alternate drive of the coils 11*a* and 11*b* when the warm-up starts, each of the coils 11*a* and 11*b* needs to be configured for the 1,400 W specification (capable of independently supplying a high-frequency output equivalent to 1,400 W). However, configuring each of the coils 11*a* and 11*b* to comply with the specification capable of 1,400 W output increases the size and the self-inductance of the coil itself.

A coil with large passing power increases heating of the coil itself. Such a coil needs to use a thick wire. According to circuit characteristics, if the circuit is configured to be capable of a large output (e.g., 1,400 W), it may be difficult to use the circuit for small outputs such as 600 to 700 W outputs.

Accordingly, the specified power can be supplied to the coils 11*a* and 11*b* respectively as shown in FIG. 10 or 13. Immediately after the warm-up (power-on), the coils 11*a* and 11*b* are driven simultaneously. That is, the both coils are powered simultaneously. When the fixing roller 2 reaches a specified temperature and/or a specified time period passes after initiation of the warm-up, the coils 11*a* and 11*b* are driven alternately and independently. That is, approximately the same power is supplied to the respective coils alternately and independently. This method can prevent the coil's size or self-inductance from increasing.

In this case, it is possible to suppress heating of the coil itself, eliminating the need for using a thick wire. When the coils 11*a* and 11*b* are configured so that the maximum suppliable power of 700 W is available in a district with the 1.5 kW rating, for example, the coils 11*a* and 11*b* can be driven simultaneously or independently.

Depending on power supply requirements in a country and a district where the copying apparatus 101 is installed, it is expected that it may be necessary to use coils of approximately 1,800 W.

Also in this case, allowing the maximum suppliable power of 900 W for each coil can prevent the coil's size or self-inductance from increasing.

When there is provided a plurality of coils 11*a* and 11*b* capable of independently heating the center and both ends of the fixing roller 2, the coils for heating the center and the both ends may be simultaneously driven at the time of paper feed (image formation) or standby.

However, various sizes (widths) of paper are used during paper feed (image formation). Naturally, different amounts of heat are needed for the approximate center and both ends of the fixing roller 2 according to size (width) of paper for image formation.

Conventionally, there is widely used a technique of independently increasing output from a coil used for heating a portion requiring a large amount of heat according to the size of paper used for the image formation.

As an example, the end coil is supplied with 600 W and the center coil is supplied with 600 W in order to form images on A3 paper having a width of 297 mm. When A4-size paper is fed so that its shorter side parallels the fixing roller 2 in an axial direction, the power of 800 W is distributed to the center coil and 400 W to the end coil.

In this example, when the coil and the coil pair are each configured for almost the same maximum suppliable power, the coils are supplied with powers having frequencies capable of generating the above-mentioned powers with a ratio of 2:1. Applying such powers causes a large difference between frequencies of the powers applied to the coil and the coil pair.

This causes an interference sound between the center coil and the end coil. Naturally, this also increases the mutual induction between the first and second drive circuits 56*a* and 56*b*, degrading the usage efficiency of input power.

For this reason, it is preferable to simultaneously drive the coils 11*a* and 11*b* during the warm-up requiring a large power to be supplied, or alternately and independently drive the coils at the time of paper feed (image formation) or standby.

When the coils 11*a* and 11*b* are driven alternately, it is preferable to provide almost the same output (rated value) from each coil for the above-mentioned reason.

In this case, each coil's output can be freely changed by varying the time for alternate drive, i.e., the time for supplying the power to each coil. Accordingly, the voltage fluctuation can be also decreased.

As mentioned above, alternately driving the coils with almost the same output (rated value) generates no interference sound at the time of paper feed or standby. An effect of the mutual induction is negligible.

The above-mentioned embodiment of the present invention has explained the example of simultaneously driving the coils during the warm-up or for return to the normal state from the preheating (power saving) mode. The respective coils may be driven simultaneously only for a specified period during the warm-up. The alternate drive may be enabled when the surface temperature of the roller 2 reaches a specified temperature. For example, the simultaneous drive may be enabled while the fixing roller 2 and the pressure roller 3 are inactive. When these rollers are rotated, the alternate drive may be enabled to alternately change the coils to be supplied with a specified power.

If the fixing roller 2 is finally heated to a uniform temperature in the longitudinal direction upon completion of the warm-up, it is possible to freely configure the in-progress heat control, i.e., changeover between the simultaneous drive and the alternate drive.

The following describes yet another example of the drive control applicable to the heating apparatus using an induction coil as the heat-up mechanism as shown in FIG. 2, for example. The drive control described below is applied to a heating apparatus including at least two coils.

Generally, the heating apparatus may be heated to a specified temperature. When the temperature detected for the object to be heated is lower than the specified temperature, the CPU provides an instruction to operate the drive circuit so that the drive circuit for the induction circuit is supplied with output generated by the high frequency with a specified frequency. As a result, the inverter circuit including the induction coil turns on to supply the induction coil with high-frequency current having a specified frequency. The frequency of the high-frequency current supplied to the induction coil varies with the time for turning on a switching element in the inverter circuit.

Namely, the magnitude of the power generated from the induction coil is set by varying the frequency of the high-frequency current supplied to the induction coil.

When the induction coil is supplied with the high-frequency current having a specified frequency, there is performed special control called the soft start.

The soft start is a drive method for decreasing a rush current to the coil. Further, this method gradually increases the time for turning on the switching element, assuming that an output value may fluctuate due to a change of the load state, environmental condition, etc. Generally, the soft start is used when the power starts to be supplied to the heating apparatus including the induction coil.

Let us consider a case where the excitation unit in FIG. 10 drives the fixing apparatus in FIG. 2, for example. Control is provided to alternately drive the coils 11*a* and 11*b*, wherein the coil 111*a* heats the center of the fixing roller 2 and the coil 11*b* can heat both ends of the roller. Namely, the coils are driven so that an output of 1,200 W can be supplied to each coil. In this case, the CPU 57 provides the drive circuits 56*a* and 56*b* with the drive frequency (time for turning on the switching element). The drive frequency is sequentially set so as to be capable of generating 600 W, 900 W, and finally 1,200 W.

In this case, the input power is detected by an input detection mechanism 60 and is fed back to the current flowing through each coil and the coil pair and the voltage applied to the coil and the coil pair. Finally, the coil and the coil pair are supplied with the high-frequency current having a specified frequency capable of generating the 1,200 W output.

The above-mentioned soft start requires a time period of several hundred milliseconds to several seconds for driving the coil and the coil pair so as to be able to generate specified output. When a plurality of coils is alternately driven as explained in the above-mentioned embodiment, however, using the soft start for each changeover fluctuates the magnitude of power supplied to each coil. This indicates that it is difficult to heat the fixing roller 2 to a specified temperature adversely to the present invention requested to heat the fixing roller 2. Namely, there arises a problem of increasing the time needed to heat the fixing roller 2 to a specified temperature or preventing the fixing roller 2 from being heated to a specified temperature.

This indicates that, when alternately driving a plurality of coils, the soft start should be used for the coil to be driven first and not be used each time the coil to be driven is selected.

When the soft start is used each time the coil to be driven is selected, the respective coils fluctuate outputs. In this case, there may arise a problem of flickering a fluorescent lamp near the copying apparatus.

FIGS. 14A, 14B, and 14C are timing charts for explaining an example of an IH drive signal supplied to the drive circuit from the CPU and the power of a specified frequency supplied to respective coils from the drive circuit along the time series when the excitation unit in FIG. 10 drives the fixing apparatus in FIG. 2.

For example, it is assumed that the CPU 57 supplies an IH drive signal to each of the drive circuits 56*a* and 56*b* at the timing shown in FIG. 14A. As shown in FIGS. 14B and 14C, the drive circuits 56*a* and 56*b* respectively supply the power to the coils 11*a* and 11*b* on the basis of alternate drive.

When the IH drive signal is supplied to the drive circuits 56*a* and 56*b* at the timing shown in FIG. 14A, the known soft start is applied to specified outputs first supplied from the drive circuits 56*a* and 56*b* to the corresponding coils 11*a* and 11*b*. Namely, the soft start is applied to intervals A and C in FIG. 14B and intervals B and D in FIG. 14C. In this case, the high-frequency current with a specified frequency is supplied to the coils 11*a* and 11*b* for a given time period. This time period is set to any value according to the corresponding temperature and the CPU setting.

As shown in FIGS. 14B and 14C, no soft start is applied to supply of the high-frequency output to any coil during intervals other than those in which the drive circuits 56*a* and 56*b* first output the power to be supplied to the corresponding coils.

In this case, an output value fluctuates due to a change of the load state, environmental condition, etc. This does not cause a serious problem because the power supply due to the first soft start can check the degree of the fluctuation. The first soft start also checks whether to decrease a rush current. Since coils to be used are designed on condition of the alternate drive, it is possible to limit the rush current magnitude within a predetermined range.

FIGS. 15 and 16 are graphs showing an output change of the coil with the use of the soft start and an output change of the coil by directly supplying the high-frequency current with a specified frequency output to the coil without the use of the soft start.

As mentioned above by using FIGS. 14B and 14C, the soft start is applied to the first supply of the high-frequency output described in FIG. 15. After the soft start is applied, as shown in FIG. 17, it is possible to obtain given output with a small output fluctuation without using the soft start.

At this time, the specified output can be easily maintained even if a changeover is made to the coil to be driven, causing a small output fluctuation (voltage fluctuation). Since the specified output is always ensured, the efficiency is improved and the power consumption can be decreased.

According to the embodiment, the surface of the fixing roller 2 is heated to the specified temperature to turn off the IH drive output at a given timing. Thereafter, during the subsequent heat-up process, the soft start is performed like the initial start-up when each coil is first supplied with the high-frequency having the specified frequency.

For example, however, no image formation is performed for a specified period of time. The temperature of the roller 2 may be higher than a temperature immediately after the copying apparatus 101 is powered, e.g., at the beginning of a daily operation. In this case, the soft start is not always needed for the repetitive drive after the IH drive output is once turned on.

FIGS. 17A, 17B, and 17C are timing charts for explaining the timing for changing coils to be driven in the heating apparatus containing a plurality of coils.

As mentioned above with reference to FIG. 2, for example, the specified power is supplied to the coil 11*a* for heating the center of the fixing roller 2 and the coil 11*b* for heating the both ends thereof. When there is a difference between temperatures detected by the first and second thermistors 6*a* and 6*b* during changeover of the coil to be driven, the specified power is supplied to either coil. At this time, for example, the excitation unit as shown in FIG. 10 may be used for changeover of the power supply to the coil to be driven. In this case, there is detected a point causing 0 volt every half wave at the primary side, i.e., between terminals of the commercial power supply. The changeover is made within a specified time period with reference to the 0-volt point.

In more detail, when a changeover is made to the coil to be driven, the voltage fluctuation, if occurred, is conditioned so as not to cause flickering of a fluorescent lamp etc. near the place where the copying apparatus 101 is installed. Considering a point causing 0 volts every half wave in the commercial power supply, the time period for changeover is set to 50 msec or less from the 0-volt point.

The embodiment of the present invention provides a specified range equivalent to coil outputs for a difference between high-frequency outputs with specified frequencies supplied from the respective coils.

When the respective coils can be supplied with the maximum output of 1.2 kW equivalent to the power, for example, a difference between powers (a difference between outputs from the coils) suppliable to the coils is defined to be approximately 200 W (approximately 30%) or less.

When the heating apparatus includes a plurality of coils, the output fluctuation can be suppressed by providing a specified range of output levels for the coils.

As mentioned above, a plurality of coils can be driven alternately by providing them with high frequencies having specified frequencies. The IH drive signal is supplied to each drive circuit connected to a given coil. At this time, the soft start is applied only when the drive circuit first supplies the corresponding coil with the power having the specified frequency. This can suppress the output fluctuation (fluctuation of the power to be supplied). Since the specified output is stably ensured, the efficiency is improved and the power consumption can be decreased.

When a plurality of coils is driven alternately, making the coil changeover with an interval of 50 msec or less from the 0-volt point in the input voltage decreases flickering of a nearby fluorescent lamp etc.

Further, the heating apparatus according to the present invention specifies approximately the same output (power) for a plurality of coils. This suppresses the output fluctuation during changeover to the coil to be driven and improves the usage efficiency of input.

The above-mentioned various heating apparatuses do not impose special limitations on the coil shape and availability of the core materials. The drive method according to the present invention is applicable to two or more coils. The temperature control can be further fine-tuned by providing thermistors for detecting the temperature of an object to be heated corresponding to the number of installed coils. It is possible to prevent the uneven temperature on the object to be heated in the longitudinal direction.

The shape of an object to be heated is not limited to be cylindrical such as a roller but may be a film, for example.

The form of the IH drive circuit is not especially subject to limitations. The circuit operation system can use a low-order class-E circuit and a half bridge, for example.

The magnitude of input power may be measured at the commercial power supply side and may be found from currents flowing between the induction coil terminals and through the respective coils.

Obviously, any frequency is available for the power suppliable to each coil.

As mentioned above, the fixing apparatus according to the present invention heats the cylindrical roller by means of induction heating and fixes toner (transferred to the paper) onto the paper. At this time, the fixing apparatus can shorten the start-up time (the time from the power-on initiation until the time when a specified temperature is reached) needed for heating the cylinder's metal layer to the specified temperature from a non-powered state.

There is provided a plurality of coils supplied with currents for heating the object to be heated. The respective coils are alternately supplied with high-frequency outputs having specified frequencies. The IH drive signal is supplied to each drive circuit connected to a given coil. At this time, the soft start is applied only when the drive circuit first supplies the corresponding coil with the high-frequency output having the specified frequency. This can suppress the output fluctuation. Since the specified output is stably ensured, the efficiency is improved and the power consumption can be decreased.

When a plurality of coils is driven alternately, making the coil changeover with an interval of 50 msec or less from the 0-volt point in the input voltage decreases flickering of a nearby fluorescent lamp etc.

Further, the heating apparatus according to the present invention specifies approximately the same output for a plurality of coils. This suppresses the output fluctuation during changeover to the coil to be driven (the coil to be powered) and improves the usage efficiency of input.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A heating apparatus comprising:

a first coil member and a second coil member, wherein each coil member heats an object;

a first temperature detection mechanism and a second temperature detection mechanism, wherein the first temperature detection mechanism detects a temperature as a result of heating said object by supplying said first coil member with a first specified output and the second temperature detection mechanism detects a temperature as a result of heating said object by supplying said second coil member with a second specified output; and an output control mechanism which can respectively supply said first and second coil members with said first and second specified outputs, wherein said output control mechanism continuously supplies said first coil member with said first specified output until said first temperature detection mechanism detects that said first coil member heats said object and consequently the temperature of an area heated by said first coil member reaches a specified temperature, and said second coil member is not supplied with said second specified output while said first coil member is supplied with said first specified output;

wherein said first temperature detection mechanism detects that the temperature of said object reaches a specified temperature, at which point said first specified output stops to be supplied to said first coil member and said second specified output is supplied to said second coil member, and wherein said second temperature detection mechanism detects that said second coil member heats said object and consequently the temperature of an area heated by said second coil member reaches a specified temperature, at which point a comparison is made between a temperature detected by said first temperature detection mechanism and a temperature detected by said second temperature detection mechanism, and, as a result, said respective coil members are alternately supplied with said first and second specified outputs so as to heat said object's area indicating a lower temperature.

2. The heating apparatus according to claim 1, wherein the heating intensity output from said first coil member almost equals the heating intensity output from said second coil member.

3. The heating apparatus according to claim 1, wherein there is a tolerance of approximately up to 30% for a difference, if any, between said first specified output supplied to said first coil member and said second specified output supplied to said second coil member.

4. The heating apparatus according to claim 1, wherein said first temperature detection mechanism detects that the temperature of said object reaches a specified temperature, at which point said first specified output stops to be supplied to said first coil member and said second specified output is supplied to said second coil member, and wherein said second temperature detection mechanism detects that said second coil member heats said object and consequently the temperature of an area heated by said second coil member reaches a specified temperature, at which point said first and second specified outputs are simultaneously supplied to said first and second coil members until the temperature detected by said first temperature detection mechanism and the temperature detected by said second temperature detection mechanism reach a specified temperature.

5. The heating apparatus according to claim 1, further including an input detection mechanism which detects power supplied from a commercial power supply to at least one of said first and second coil members or to said first and second coil members simultaneously, wherein said input detection mechanism is shared both when said first and second coil members are simultaneously supplied with said first and second specified outputs respectively and when said respective coil members are alternately supplied with said first and second specified outputs.

6. The heating apparatus according to claim 1, wherein when said respective coil members are alternately supplied with said first and second specified outputs, a changeover is made to supply of said first and second specified outputs to a coil member to be driven according to the zero cross control, and wherein no time difference occurs during the changeover.

7. A heating apparatus comprising:

a first coil member and a second coil member, wherein each coil member heats an object;

a first temperature detection mechanism and a second temperature detection mechanism, wherein the first temperature detection mechanism detects a temperature as a result of heating said object by supplying said first coil member with a first specified output and the second temperature detection mechanism detects a temperature as a result of heating said object by supplying said second coil member with a second specified output; and an output control mechanism which can respectively supply said first and second coil members with said first and second specified outputs, wherein said output control mechanism can select either a first control method of simultaneously driving said first and second coil members or a second control method of driving said coil members alternately by not driving the other coil member when said first coil member or said second coil member is driven, wherein said first and second coil members are simultaneously driven at least in a warm-up time, and wherein said first and second control methods are changed in said control according to an operation state of an apparatus in which the heating apparatus is installed.

8. The heating apparatus according to claim 7, wherein when said coil members are driven alternately, a changeover is made to supply of said first and second specified outputs to a coil member to be driven according to the zero cross control, and wherein no time difference occurs during the changeover.

9. The heating apparatus according to claim 7, wherein there may be a tolerance of approximately up to 30% for a difference, if any, between a first heating intensity output from said first coil member based on said first specified output supplied to said first coil member and a second heating intensity output from said second coil member based on said second specified output supplied to said second coil member.

10. The heating apparatus according to claim 7, wherein said control is defined so that there can be provided a larger sum of heating intensities generated from said first and second coil members simultaneously supplied with said first and second specified outputs compared to a sum of heating intensities generated from said first and second coil members independently supplied with said first and second specified outputs.

11. The heating apparatus according to claim 7, wherein said control can simultaneously drive said first and second coil members even if said respective coil members are driven independently if outputs which are supplied to said respective coil members and are available for generating said heating intensities do not reach an output limit value for generating said heating intensities that can be output from said respective coil members.

12. The heating apparatus according to claim 7, further comprising an input detection mechanism which detects power supplied from a commercial power supply to at least one of said first and second coil members, wherein said input detection mechanism is shared both when said first and second coil members are driven simultaneously and when both coil members are driven alternately.

13. The heating apparatus according to claim 12, wherein when said first control method is selected, said in put detection mechanism detects an output from a power supply side before said output is rectified to detect the sum of said heating intensities output from said first and second coil members, wherein when said first and second coil members are driven alternately, and also when said second control method is selected, said input detection mechanism detects an output from said power supply side to detect said heating intensities output from said respective coil members, and wherein when said coil members are driven simultaneously, the currents flowing through said first and second coil members and voltages applied to both ends thereof are detected in order to measure said heating intensities output from said respective coil members.

14. A heating apparatus comprising;

a first coil member and a second coil member, wherein each coil member heats an object;

a first temperature detection mechanism configured to detect a temperature as a result of heating said object by supplying said first coil member with a first specified output and a second temperature detection mechanism configured to detect a temperature as a result of heating said object by supplying said second coil member with a second specified output; and an output control mechanism which can respectively supply said first and second coil members with said first and second specified outputs, wherein when said first and second coil members are supplied with said first and second specified outputs, from a state of all coil members turned off, at least either coil member is supplied with either of said first and second specified outputs and wherein, until the heating intensity generated from the coil member supplied with the output reaches a specified magnitude, said output control mechanism gradually increases said first and second specified outputs at a given interval, and wherein when said output control mechanism supplies said specified output corresponding to either coil member, alternate drive control not to drive the other coil member applies a soft start with given characteristics only on condition that said respective coil members are first supplied with either of said first and second specified outputs, and wherein a non soft start is applied subsequently on condition that the corresponding coil member is alternately supplied with either of said first and second specified outputs.

15. The heating apparatus according to claim 14, wherein when said coil members are driven alternately, a changeover is made to supply of said first and second specified outputs to a coil member to be driven according to the zero cross control, and wherein no time difference occurs during the changeover.

16. The heating apparatus according to claim 14, wherein said first and second coil members are respectively supplied with said first and second specified outputs which are almost the same.

17. The heating apparatus according to claim 14, wherein there is a tolerance of approximately up to 30% for a difference, if any, between said first specified output supplied to said first coil member and said second specified output supplied to said second coil member.

18. The heating apparatus according to claim 14, further comprising an input detection mechanism which detects power supplied from a commercial power supply to at least one of said first and second coil members or to said first and second coil members simultaneously, wherein said input detection mechanism is shared both when said first and second coil members are driven simultaneously and when both coil members are driven alternately.

19. A heating apparatus comprising:

a first coil member and a second coil member, wherein each coil member heats an object;

a first temperature detection mechanism and a second temperature detection mechanism, wherein the first temperature detection mechanism detects a temperature as a result of heating said object by supplying said first coil member with a first specified output and the second temperature detection mechanism detects a temperature as a result of heating said object by supplying said second coil member with a second specified output; and an output control mechanism which can respectively supply said first and second coil members with said first and second specified outputs, wherein said output control mechanism continuously supplies said first coil member with said first specified output until said first temperature detection mechanism detects that said first coil member heats said object and consequently the temperature of an area heated by said first coil member reaches a specified temperature, and said second coil member is not supplied with said second specified output while said first coil member is supplied with said first specified output, wherein said first temperature detection mechanism detects that the temperature of said object reaches a specified temperature, at which point said first specified output stops to be supplied to said first coil member and said second specified output is supplied to said second coil member, and wherein said second temperature detection mechanism detects that said second coil member heats said object and consequently the temperature of an area heated by said second coil member reaches a specified temperature, at which point said first and second specified outputs are simultaneously supplied to said first and second coil members until the temperature detected by said first temperature detection mechanism and the temperature detected by said second temperature detection mechanism reach a specified temperature.

20. The heating apparatus according to claim 19, wherein the heating intensity output from said first coil member almost equals the heating intensity output from said second coil member.

21. The heating apparatus according to claim 19, wherein there is a tolerance of approximately up to 30% for a difference, if any, between said first specified output supplied to said first coil member and said second specified output supplied to said second coil member.

22. A heating apparatus comprising:

a first coil member and a second coil member, wherein each coil member heats an object;

a first temperature detection mechanism and a second temperature detection mechanism, wherein the first temperature detection mechanism detects a temperature as a result of heating said object by supplying said first coil member with a first specified output and the second temperature detection mechanism detects a temperature as a result of heating said object by supplying said second coil member with a second specified output;

an input detection mechanism which detects power supplied from a commercial power supply to at least one of said first and second coil members; and an output control mechanism which can respectively supply said first and second coil members with said first and second specified outputs, wherein said output control mechanism can select either a first control method of simultaneously driving said first and second coil members or a second control method of driving said coil members alternately by not driving the other coil member when said first coil member or said second coil member is driven, wherein said input detection mechanism is shared both when said first and second coil members are driven simultaneously and when both coil members are driven alternately, and wherein when said first control method is selected, said input detection mechanism detects an output from a power supply side before said output is rectified to detect the sum of said heating intensities output from said first and second coil members, wherein when said first and second coil members are driven alternately, and also when said second control method is selected, said input detection mechanism detects an output from said power supply side to detect said heating intensities output from said respective coil members, and wherein when said coil members are driven simultaneously, the currents flowing through said first and second coil members and voltages applied to both ends thereof are detected in order to measure said heating intensities output from said respective coil members.

* * * * *